US012618258B1

(12) United States Patent
Hu

(10) Patent No.: US 12,618,258 B1
(45) Date of Patent: May 5, 2026

(54) EASY SETUP CAMPING TENT

(71) Applicant: Shandong Longming Information Technology Co., Ltd, Qingdao City (CN)

(72) Inventor: Chengji Hu, Qingdao (CN)

(73) Assignee: Shandong Longming Information Technology Co., Ltd, Qingdao City (CN)

( * ) Notice: Subject to any disclaimer, the term of this patent is extended or adjusted under 35 U.S.C. 154(b) by 0 days.

(21) Appl. No.: 19/226,092

(22) Filed: Jun. 2, 2025

(30) Foreign Application Priority Data

May 23, 2025 (CN) ..... 202510677509.8

(51) Int. Cl.

| | |
|---|---|
| ***E04H 15/20*** | (2006.01) |
| ***E04H 15/06*** | (2006.01) |
| ***E04H 15/14*** | (2006.01) |
| ***E04H 15/18*** | (2006.01) |

(52) U.S. Cl.
CPC ..... *E04H 15/20* (2013.01); *E04H 15/06* (2013.01); *E04H 15/14* (2013.01); *E04H 15/18* (2013.01); *E04H 2015/201* (2013.01)

(58) Field of Classification Search
CPC ..... E04H 15/20; E04H 2015/201
See application file for complete search history.

(56) References Cited

U.S. PATENT DOCUMENTS

| | | | | | |
|---|---|---|---|---|---|
| 1,964,818 | A * | 7/1934 | Hood | E04H 15/20 | 52/2.21 |
| 2,297,150 | A * | 9/1942 | Hunter | E04H 15/20 | 52/2.21 |
| 2,752,928 | A * | 7/1956 | Barker | E04H 15/20 | 52/2.21 |
| 2,932,304 | A * | 4/1960 | Voege | E04H 15/54 | 160/DIG. 7 |
| 2,955,606 | A * | 10/1960 | Walker | E04H 15/20 | 52/2.21 |
| 4,251,959 | A * | 2/1981 | Hsu | E04H 15/20 | 52/2.21 |
| 4,296,960 | A * | 10/1981 | Winchester | B60P 3/32 | 135/88.13 |
| 4,332,112 | A * | 6/1982 | Hsu | E04H 15/32 | 52/2.21 |
| 5,692,795 | A * | 12/1997 | Mininger | E04H 15/20 | 296/159 |
| 5,987,822 | A * | 11/1999 | McNiff | E04H 15/20 | 52/2.13 |
| 6,021,796 | A * | 2/2000 | Vavra | E04H 15/40 | 135/147 |
| 9,499,970 | B2 * | 11/2016 | Milo | E04B 1/165 | |
| 9,624,688 | B1 * | 4/2017 | Tyson | E04H 15/06 | |
| 2008/0190472 | A1 * | 8/2008 | Turcot | E04H 15/20 | 135/126 |
| 2008/0210282 | A1 * | 9/2008 | Turcot | E04H 15/06 | 135/88.14 |
| 2022/0325553 | A1 * | 10/2022 | Cangemi | E04H 15/18 | |

* cited by examiner

*Primary Examiner* — Noah Chandler Hawk
(74) *Attorney, Agent, or Firm* — Che-Yang Chen

(57) ABSTRACT

An easy setup camping tent includes a tent body and an inflatable support assembly connected to the tent body, wherein the tent body is unfolded when the inflatable support assembly is inflated. The camping tent is arranged for being used on a pickup truck and fit to be easy setup on the truck bed.

3 Claims, 38 Drawing Sheets

EASY SETUP CAMPING TENT

CROSS REFERENCE OF RELATED APPLICATION

This application is a non-provisional application that claims priority under 35U.S.C. § 119 to China application number CN202510677509.8, filing date May 23, 2025, wherein the entire content of which is expressly incorporated herein by reference.

BACKGROUND OF THE PRESENT INVENTION

Field of Invention

The present invention relates to camping tent, and more particularly to an inflatable easy setup camping tent for pickup truck.

Description of Related Arts

A camping tent is a portable and temporary shelter widely used for outdoor recreational activities such as hiking, backpacking, or camping. In addition, a camping tent designed for use on a pickup truck addresses multiple limitations of traditional ground tents and offers practical benefits for outdoor enthusiasts, overlanders, and travelers. The demand for such tents arises from the growing need for comfort, mobility, and safety in outdoor camping.

The conventional camping tent is generally made of fabric stretched over poles or frames. During the setup process, threading poles through long, narrow sleeves can take significantly much time since alignment must be precise, or poles can get stuck midway. Poles may snag, bend, or break during insertion if sleeves are tight or if excessive force is used. Friction between the sleeve fabric and the pole can make sliding difficult. Sleeves can flap or twist in the wind, making it harder to align and insert poles. In addition, single-person setup can be awkward and difficult.

SUMMARY OF THE PRESENT INVENTION

The invention is advantageous in that it provides an easy setup camping tent which can be convenient to setup by inflating an inflatable support assembly to cause a tent body to be automatically unfolded for camping.

Another advantage of the present invention is to provide an easy setup camping tent which can be used on a ground. Particularly, the camping tent can be used on a truck bed to keep the user elevated, so as to offer a cleaner, drier, and safer camping environment, and the user can set up camp anywhere their vehicle can go, without the need to find flat, clear ground, so that it is ideal for road trips, remote camping, and overlanding, where traditional campsites may not be available.

Another advantage of the present invention is to provide an easy setup camping tent, wherein the easy setup camping tent can be fitted and conformed to the truck bed, so as to deliver a clean, custom-fit look while maximizing comfort and functionality. The side walls of the truck bed will retain the camping tent in position.

Another advantage of the present invention is to provide an easy setup camping tent, wherein a floor of the tent body is formed with two protruding portions which are capable of accommodating two raised wheel wells on the bed of the pickup truck, so that the contoured bottom surfaces of the two protruding portions help the tent body anchor more securely, minimizing lateral movement or shifting during use. In addition, with such conforming configuration, a better seal between the tent body and the truck bed prevents rainwater or wind from entering through gaps caused by uneven surfaces. With designated areas for the wheel wells, the tent body is also easier to align and position correctly during installation. The user does not have to guess or manually adjust the floor to fit awkwardly around the raised wheel wells.

Another advantage of the present invention is to provide an easy setup camping tent which is designed not only to prevent water from accumulating on its top and bottom surfaces as well as to effectively block water from entering the interior of the tent body.

Another advantage of the present invention is to provide an easy setup camping tent, wherein once inflated, the inflatable support assembly forms a pressurized structure that is rigid and resilient, capable of withstanding strong gusts of wind without collapsing or deforming. This enhances safety and stability during adverse weather conditions.

Another advantage of the present invention is to provide an easy setup camping tent which is equipped with an air pressure monitoring valve that automatically releases excess pressure when inflating, so as to ensure that the inflatable frame will not be overinflated.

Another advantage of the present invention is to provide an easy setup camping tent, wherein the tent body has dedicated air conditioning inlet and outlet ports, allowing for seamless connection to an external air conditioning unit for enhanced climate control inside the tent body.

Another advantage of the present invention is to provide an easy setup camping tent, wherein the top of the tent slopes downward in the direction towards the front of the pickup truck, which helps reduce wind resistance and also prevents rainwater from accumulating on the roof surface.

Additional advantages and features of the invention will become apparent from the description which follows, and may be realized by means of the instrumentalities and combinations particularly pointed out in the appended claims.

According to the present invention, the foregoing and other objects and advantages are attained by a camping tent which is easy to setup, comprising:

a tent body; and an inflatable support assembly connected to the tent body, wherein the tent body is unfolded when the inflatable support assembly is inflated.

According to an embodiment, the inflatable support assembly, which is mounted at an inner side of the tent body, comprises a rear frame, a front frame and a top frame connected between the rear frame and the front frame, wherein when the inflatable support assembly is inflated, along a direction from the rear frame to the front frame, the top frame gradually slopes downward.

According to an embodiment, the top frame comprises two top columns, wherein rear ends of the two top columns are connected to a same position of the rear frame, front ends of the two top columns are respectively connected to two different positions of the front frame, wherein when the inflatable support assembly is inflated, along the direction from the rear frame to the front frame, the two top columns gradually slope downward.

According to an embodiment, the top frame comprises two top columns, wherein rear ends of the two top columns are parallel and are connected between the rear frame and the front frame, wherein when the inflatable support assembly is inflated, along the direction from the rear frame to the front frame, the two top columns gradually slopes downward.

According to an embodiment, the tent body comprises a bottom layer, a top layer and an enclosing layer between the bottom layer and the top layer, wherein the rear frame comprises two rear stand columns and a rear upper column connected between the two rear stand columns, wherein the front frame comprises two front stand columns and a front upper column connected between the two front stand columns, wherein the two top columns are arranged under the top layer of the tent body and are extended between the rear upper column and the front upper column.

According to an embodiment, the camping tent is arranged for being used on a pickup truck comprising a cab and a truck bed, wherein the camping tent is arranged for being detachably mounted on the truck bed.

According to an embodiment, the truck bed comprises a floor wall and two wheel wells protruded from the floor wall, the tent body comprises a bottom layer, a top layer, an enclosing layer between the bottom layer and the top layer and two wheel well covers protruded from the bottom layer to cover the two wheel wells respectively.

According to an embodiment, the camping tent is arranged for being used on a pickup truck comprising a cab and a truck bed, wherein the camping tent is arranged for being detachably mounted on the truck bed with the front frame being located adjacent to the cab while the rear frame being located away from the cab, wherein the truck bed comprises a floor wall and two wheel wells protruded from the floor wall, the tent body comprises a bottom layer, a top layer, an enclosing layer between the bottom layer and the top layer and two wheel well covers protruded from the bottom layer to cover the two wheel wells respectively.

According to an embodiment, each wheel well comprises a top surface and a side surface connected to the top surface, each wheel cover comprises a top cover wall for covering the top surface of the corresponding wheel well and a side cover wall connected to the top cover wall for covering the side surface of the corresponding wheel well, wherein the top cover wall and the side cover wall define a wheel well cavity under the corresponding wheel well cover.

According to an embodiment, the top cover wall is an arch wall which is extended above the bottom wall of the tent body.

According to an embodiment, the truck bed comprises a plurality of side walls extended from the floor wall, the tent body comprises a plurality of shielding layers which are mounted to the enclosing layer of the tent body to cover on the side walls of the truck bed, so as to divert rainwater away from the tent body.

According to an embodiment, the tent body has a camping cavity when the tent body is unfolded, wherein the enclosing layer comprises a rear enclosing wall, a front enclosing wall, two side enclosing walls extended between the rear enclosing wall and the front enclosing wall, and a door layer coupled to the rear enclosing wall to define an access opening communicated to the camping cavity.

According to an embodiment, the enclosing layer further comprises a mesh layer at an inner side of the door layer.

According to an embodiment, the enclosing layer further comprises an upper enclosing layer which is covered on an upper end portion of the rear enclosing wall, and one or more support struts provided between the upper enclosing layer and the upper end portion of the rear enclosing wall, wherein the upper wherein the end portion of the rear enclosing wall has one or more vent holes, the one or more support struts are capable of being in a support state to allow the upper enclosing wall and the upper end portion of the rear enclosing wall to be spaced apart from each other to expose the one or more vent holes.

According to an embodiment, the bottom layer of the tent body comprises a peripheral flange which is a turned-up edge at a junction where the bottom layer is joined with the enclosing layer.

According to an embodiment, an auxiliary tent is connected to the tent body, wherein the inflatable support assembly comprises a rear frame, a front frame, a top frame connected between the rear frame and the front frame, and an auxiliary frame unit connected to the rear frame, wherein the rear frame, the front frame and the top frame are mounted at an inner side of the tent body, wherein the auxiliary frame unit is arranged to support the auxiliary tent.

According to an embodiment, the auxiliary frame unit comprises an auxiliary rear frame, an auxiliary front frame connected to the rear frame, and an auxiliary top frame connected between the auxiliary rear frame and the auxiliary front frame, when the inflatable support assembly is inflated for use, bottoms of the auxiliary rear frame and the auxiliary front frame are lower than bottoms of the rear frame and the front frame.

According to an embodiment, the rear frame comprises two rear stand columns and a rear upper column connected between the two rear stand columns, wherein the front frame comprises two front stand columns and a front upper column connected between the two front stand columns, wherein the top frame comprises two top columns which are arranged under the top layer of the tent body and are extended between the rear upper column and the front upper column, wherein the auxiliary rear frame comprises two auxiliary rear stand columns and an auxiliary rear upper column connected between the two auxiliary rear stand columns, the auxiliary front frame comprises two auxiliary front stand columns and two auxiliary front upper columns connected between the corresponding auxiliary front stand column and the rear frame, the auxiliary top frame comprises one or more auxiliary top columns connected between the auxiliary rear frame and the auxiliary front frame.

According to an embodiment, the inflatable support assembly comprises a rear frame, a front frame, a top frame connected between the rear frame and the front frame, wherein the top frame comprises a plurality of radial top columns which are radially extended between the rear frame and the front frame, wherein the plurality of radial top columns are connected to a connecting position which is located at a central area of the top frame.

According to an embodiment, the inflatable support assembly comprises a rear frame, a front frame, a top frame connected between the rear frame and the front frame, wherein the top frame comprises a plurality of radial top columns which are radially extended between the rear frame and the front frame, wherein the plurality of radial top columns are connected to a connecting position which is located adjacent to the rear frame.

According to an embodiment, a fixing layer is connected to one of the bottom layer and the enclosing layer for covering on a rear end of the truck bed.

According to an embodiment, the inflatable support assembly comprises a plurality of air columns which are integrally connected with each other and capable of being inflated simultaneously, wherein the tent body further comprises a plurality of mounting sleeves which are capable of being sleeved on the plurality of air columns respectively.

According to an embodiment, the tent body has air conditioning inlet and outlet ports.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
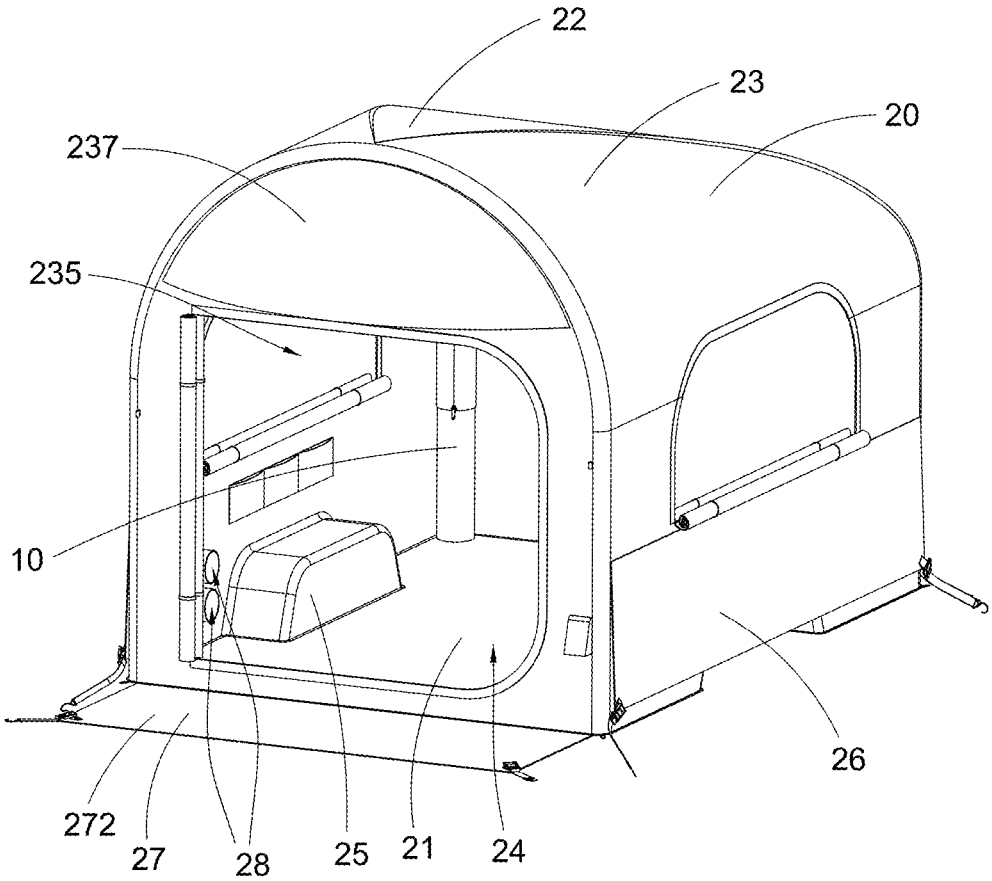
FIG. 1 is a perspective view of an easy setup camping tent according to a preferred embodiment of the present invention, wherein an access opening communicated to a camping cavity is exposed.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 20 of the drawings, an easy setup camping tent according to a preferred embodiment of the present invention is illustrated, the easy setup camping tent comprises an inflatable support assembly 10 and a tent body 20 mounted to the inflatable support assembly 10, the tent body 20 is unfolded for use when the inflatable support assembly 10 is inflated and can be folded for storage and transportation when the inflatable support assembly 10 is deflated. Accordingly, when the inflatable support assembly 10 is inflated, the tent body 20 is automatically deployed as the tent body 20 unfolds along with the inflatable support assembly 10, this automatic deployment mechanism significantly simplifies the setup process, allowing the user to erect the easy setup camping tent quickly and with minimal effort.

The easy setup camping tent can be placed and secured on a ground for camping, and in this embodiment, the easy setup camping tent is specifically adapted for installation and use on a pickup truck 1000, allowing for elevated and vehicle-integrated camping functionality.

The tent body 20 can be made of flexible and waterproof material. Typical tent materials include polyester and nylon, which are widely used for their lightweight, durable, and water-resistant properties. Polyester is especially valued for its UV resistance and dimensional stability, while nylon offers superior tear strength. Oxford fabric, often used for tent floors, provides excellent abrasion resistance. To enhance waterproof performance, tent fabrics are commonly coated with polyurethane (PU) or silicone; PU-coated materials are cost-effective and reliable, whereas silicone-coated fabrics (such as silnylon) offer better water repellency and reduced weight. For ventilation and comfort, breathable fabrics and mesh can be used in inner tents.

More specifically, the tent body 20 comprises a bottom layer 21, a top layer 22, and an enclosing layer 23 connected between the bottom layer 21 and the top layer 22 to define a camping cavity 24 when the easy setup camping tent is in the unfolded state for camping. The inflatable support assembly 10 is mounted at an inner side of the tent body 20, so that the inflated inflatable support assembly 10 can brace the tent body 20 from inside to deploy the tent body 20. In addition, the inflatable support assembly 10 is not exposed to outside, but is disposed in the tent body 20, so that the aesthetic appearance of the easy setup camping tent in the unfolded state is also enhanced. Alternatively, in other embodiments, the inflatable support assembly 10 also may be connected at an outer side of the tent body 20.

The integration of the inflatable support assembly 10 inside the tent body 20 provides internal bracing, resulting in a self-supporting and stable structure once inflated. This eliminates the need for external guy lines, rigid poles, or complex assembly steps, making it ideal for quick deployment. Accordingly, as the inflatable support assembly 10 inflates, it automatically lifts and shapes the tent body 20 into its intended form, simplifying setup and saving significant time and effort, particularly in poor weather or low-light conditions. When deflated, the inflatable support assembly 10 collapses inward, allowing the tent body 20 to be easily folded into a compact form for efficient storage and transport.

Figure 18:
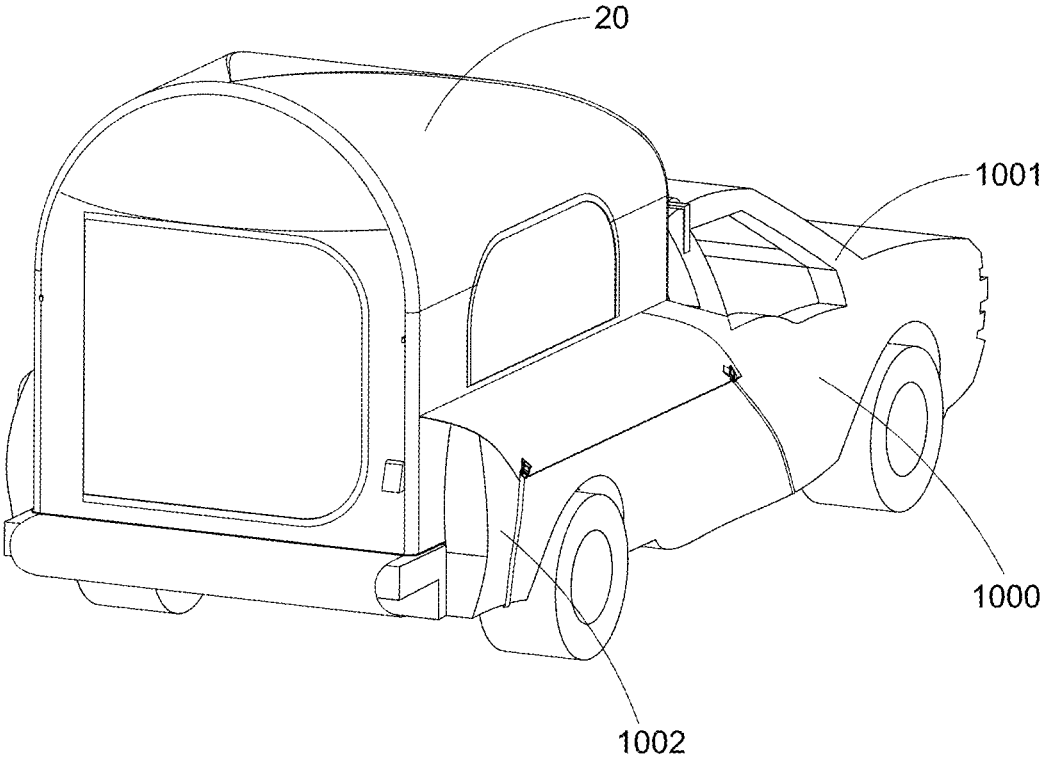
FIG. 18 is a perspective view illustrating the easy setup camping tent being setup on a pickup truck according to the above preferred embodiment of the present invention.
Figure 19:
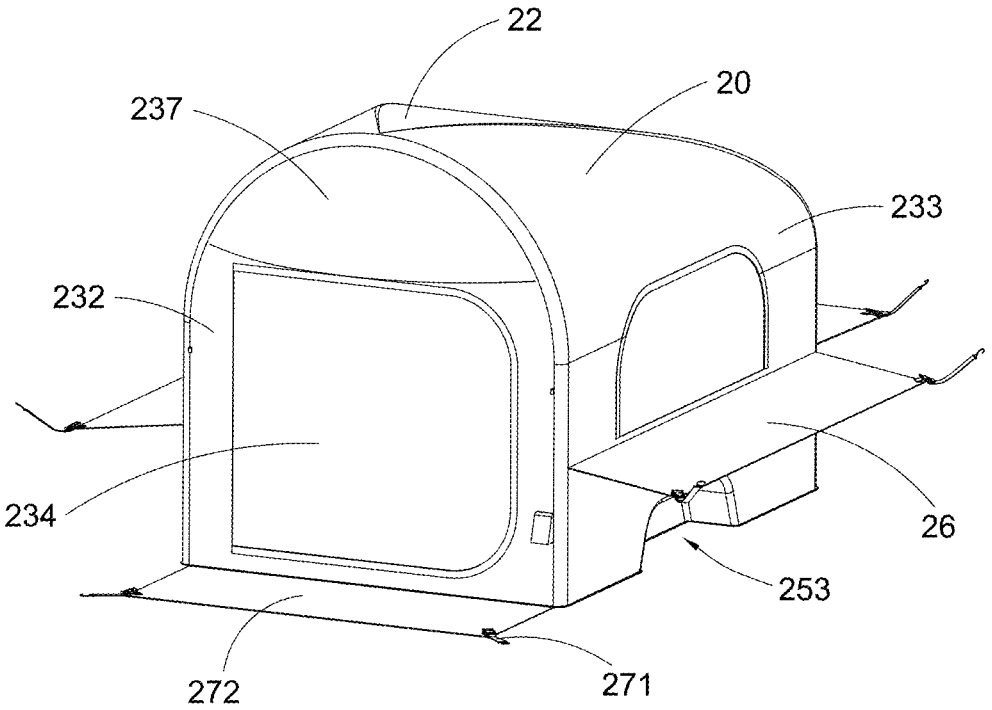
FIG. 19 is an exploded view illustrating the easy setup camping tent and the pickup truck according to the above preferred embodiment of the present invention.
Figure 19:
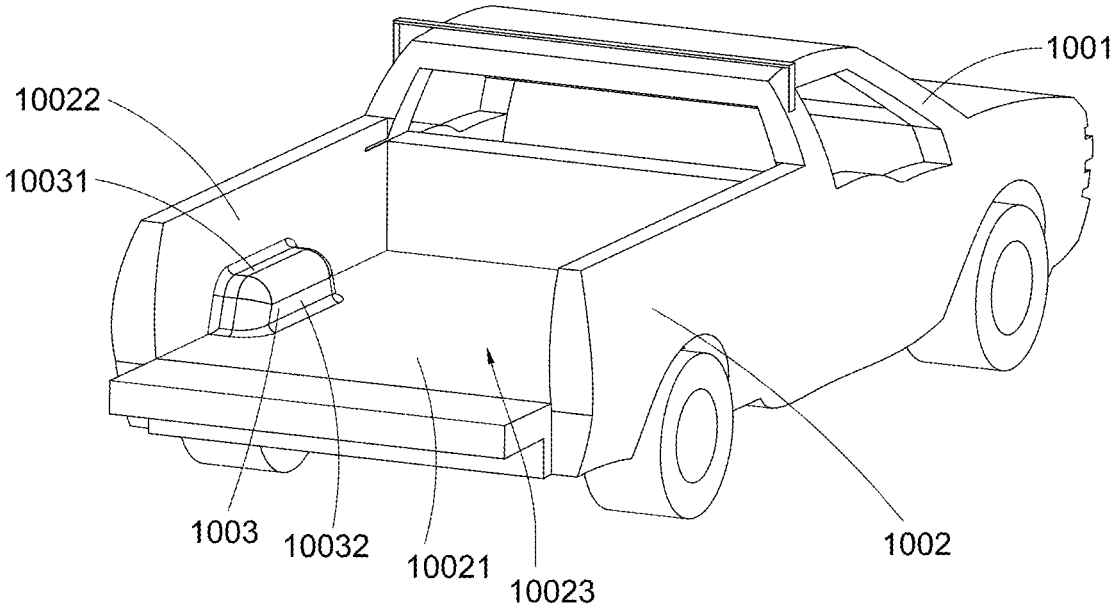
Figure 20:
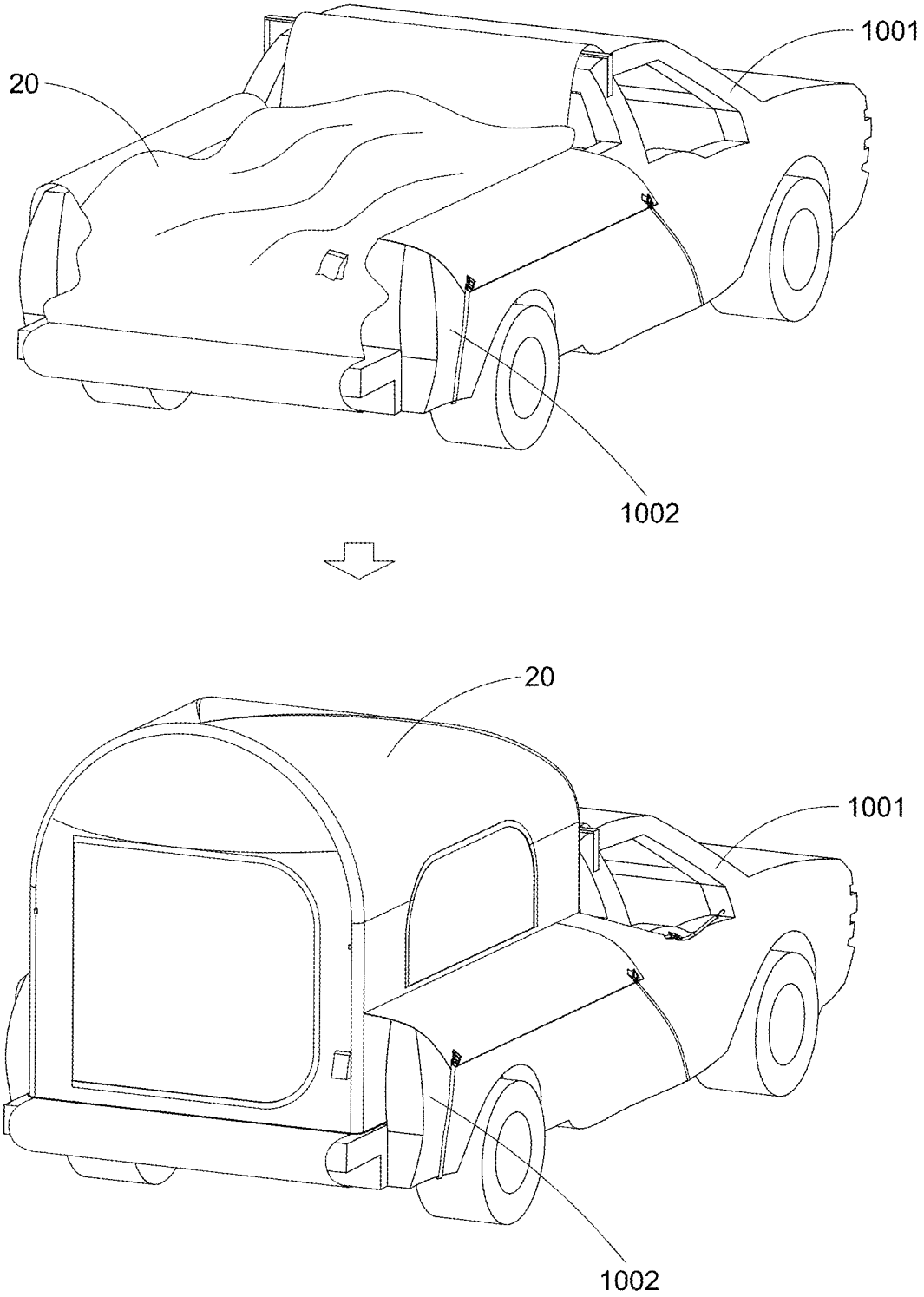
FIG. 20 is a schematic view illustrating a setup process of the easy setup camping tent on the pickup truck according to the above preferred embodiment of the present invention.

As shown in FIGS. 18 to 20, the pickup truck 1000 comprises a cab 1001 which is the front part of the pickup truck 1000 where the driver and passengers sit and a truck bed 1002 used for carrying cargoes, the easy setup camping tent of the present invention can be placed on the truck bed 1002 at a rear side of the cab 1001 for camping use.

In the present invention, a front side of the easy setup camping tent is defined as a side adjacent to the cab 1001 of the pickup truck 1000, a rear side of the easy setup camping tent is defined as a side away from the cab 1001 of the pickup truck 1000.

The truck bed 1002 comprises a floor wall 10021 and a plurality of side walls 10022 connected to the floor wall 10021 to define a bed cavity 10023, the easy setup camping tent can be placed on the floor wall 10021 and installed at the bed cavity 10023. Accordingly, the side walls 10022 act as natural barriers that limit lateral shifting of the easy setup camping tent caused by strong winds or user movement inside. This built-in containment reduces the risk of tent dislodgement or collapse during adverse weather or while sleeping. Because the side walls 10022 of the truck bed 1002 serve as part of the support system of the easy setup camping tent, there is less reliance on external tie-downs, stakes, or guy lines, so that it is especially useful on hard or uneven terrain where traditional tent anchoring is difficult or impossible. The easy setup camping tent can be quickly dropped into place and aligned with the fixed side boundaries of the truck bed 1002, streamlining the installation process.

The pickup truck 1000 may comprise two or more wheel wells 1003 protruded and raised from the floor wall 10021 of the truck bed 1002. As shown in FIG. Of the drawings, two wheel wells 1003 are respectively extended from two sides of the floor wall 10021 for holding two wheels. The tent body 20 comprises two or more raised wheel well covers 25 which are protruded from the bottom layer 21 of the tent body 20 for covering the two or more wheel wells 1003. In other words, the bottom of the tent body 20 is not a flat, uninterrupted surface, but instead includes locally raised portions, the wheel well covers 25, which are adapted to fit over and around the wheel wells 1003, allowing the tent body 20 to be securely and snugly placed on the truck bed 1002 without interference or deformation.

By conforming precisely to the structural features of the truck bed 1002, specifically the raised wheel wells 1003, the tent body 20 avoids bunching, warping, or misalignment. This ensures full contact and support across the tent bottom, enhancing structural integrity and user comfort. The integration of raised wheel well covers 25 helps the easy setup camping tent fit securely into the contour of the truck bed 1002, reducing the risk of shifting or sliding during use or in windy conditions.

Because the wheel well covers 25 are pre-formed into the bottom layer 21 of the tent body 20, there is no need for manual adjustments or additional structural modifications during setup. The tent body 20 can be quickly and intuitively aligned with the truck bed contours, speeding up installation. The tailored fit over the wheel wells 10003 also allows for better sealing against rain and wind infiltration through the bottom of the tent body 20.

In addition, rather than wasting interior space or requiring additional leveling structures, the easy setup camping tent of the present invention utilizes the existing truck bed geometry, including the wheel wells 1003. This results in maximized usable interior volume and headroom within the camping cavity.

With the wheel wells 1003 properly covered and integrated into the tent bottom, the user can experience a flatter and more even floor surface inside the tent body 20. This contributes to improved comfort for sleeping and sitting, even when the tent body 20 is installed over non-flat truck bed surfaces.

Figure 11:
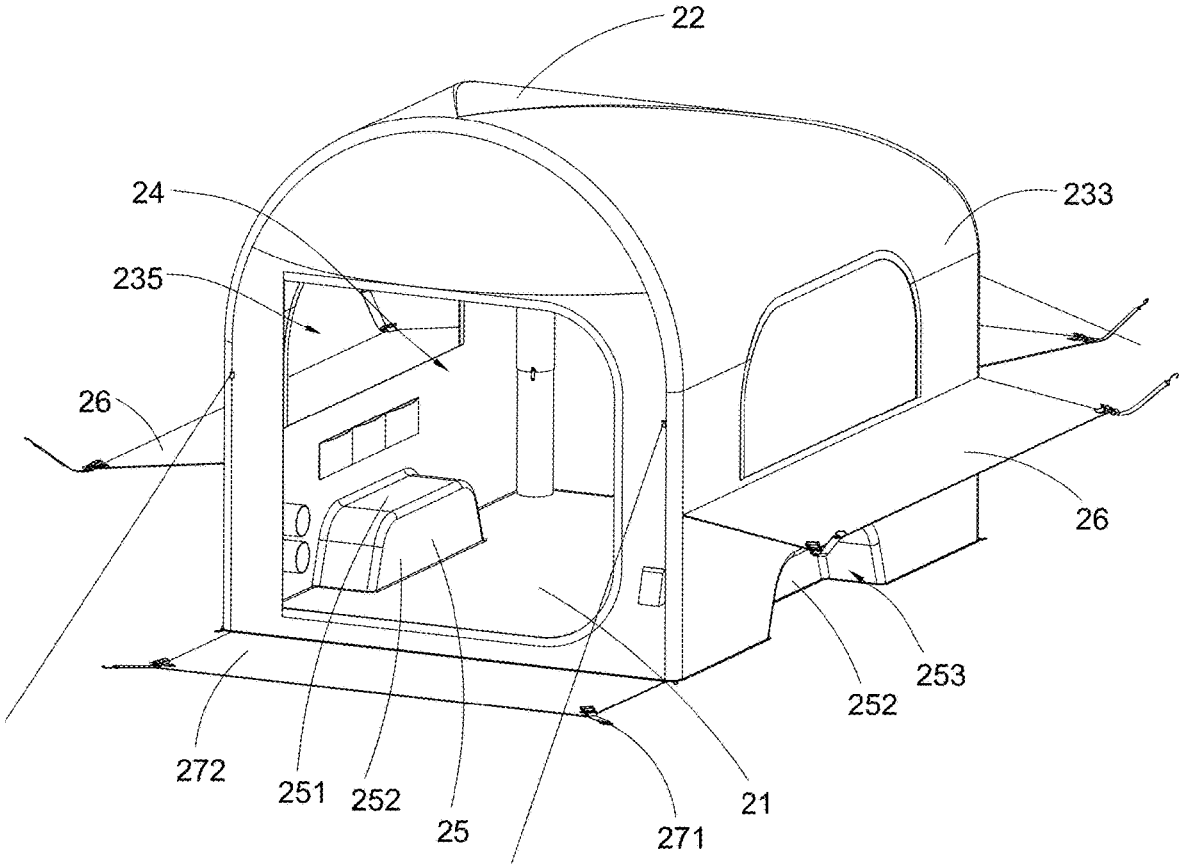
FIG. 11 is a perspective view illustrating wheel well covers and shielding layers of the tent body of the easy setup camping tent according to the above preferred embodiment of the present invention.
Figure 12:
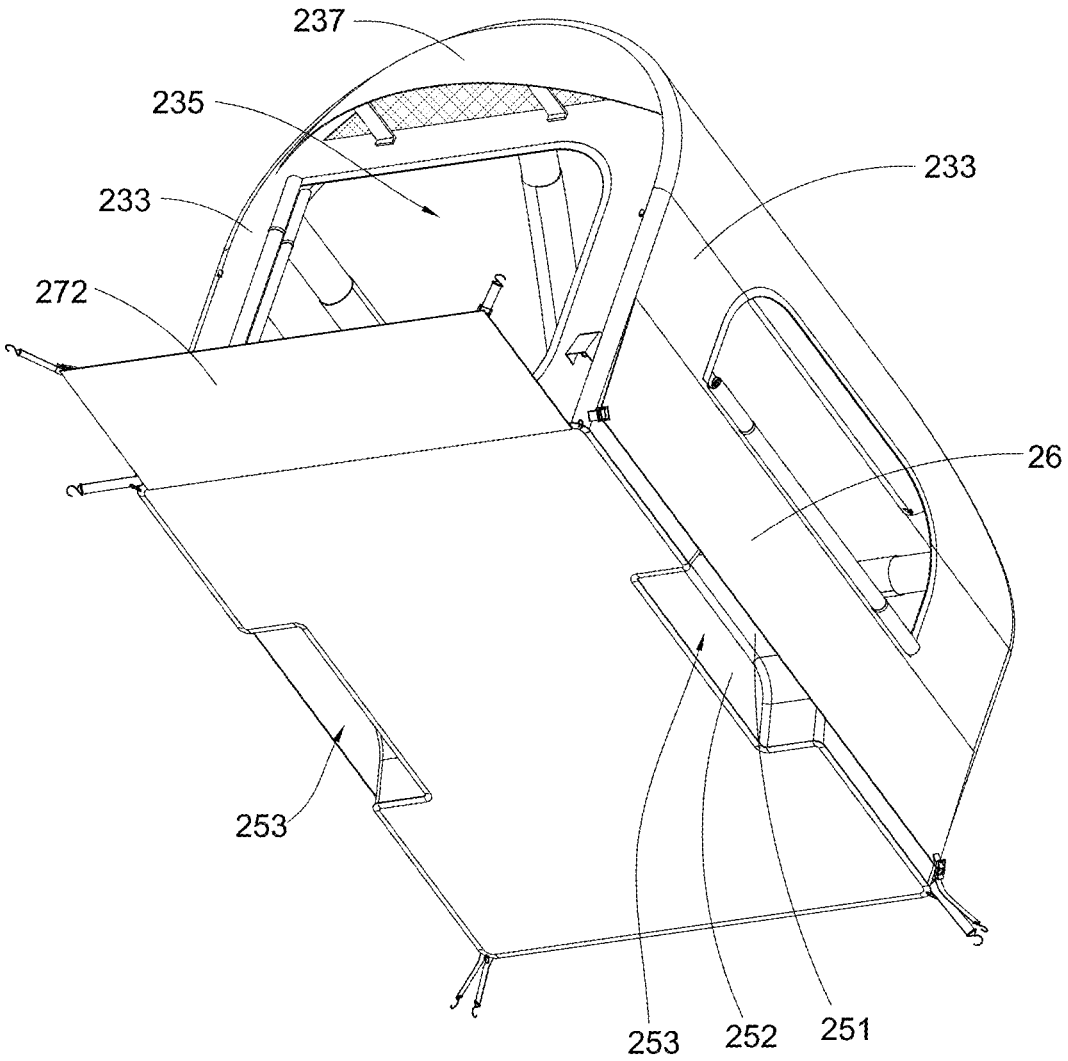
FIG. 12 is a bottom perspective view illustrating wheel well covers and shielding layers of the tent body of the easy setup camping tent according to the above preferred embodiment of the present invention.

The enclosing layer 23 of the tent body 20 comprises a front enclosing wall 231, a rear enclosing wall 232, and two side enclosing walls 233 extended between the front enclosing wall 231 and the rear enclosing wall 232. Each raised wheel well cover 25, which is extended from the bottom layer 21 and the corresponding side enclosing wall 233, comprises a top cover wall 251 connected to the corresponding side enclosing wall 233 and the bottom layer 21 and a side cover wall 252 extended between the top cover wall 251 and the bottom layer 21 to define a wheel well cavity 253 at a bottom of the wheel well cover 25 for holding the corresponding wheel well 1003, as shown in FIGS. 11 and 12.

Each wheel well 1003 comprises a top surface 10031 and a side surface 10032, the top surface 10031 is a curved surface. The top cover wall 251 of the wheel well cover 25 can be covered on the top surface 10031 of the corresponding wheel well 1003, the side cover wall 252 of the wheel well cover 25 can be covered on the side surface 10032 of the corresponding wheel well 1003. The top cover wall 251 of the wheel well cover 25 is embodied to have a curvature matched with the top surface 10031 of the corresponding wheel well 1003. As an example, the top cover wall 251 of the wheel well cover 25 and the top surface 10031 of the corresponding wheel well 1003 can be embodied as arched surfaces.

The enclosing layer 23 of the tent body 20 further comprises a door layer 234 which is coupled to the rear enclosing wall 232 to define an access opening 235 communicated to the camping cavity 24. The access opening 235 provides user entry and exit to and from the camping cavity 24. A zipper means can be connected between the door layer 234 and the rear enclosing wall 232, the zipper means may be a full-perimeter or partial-perimeter closure system, allowing the door layer 234 to be selectively opened or sealed along its edges. This access opening 235 can thus be opened for ingress and egress or securely closed to ensure privacy, protection from the environment, and enclosure of the interior space.

The zipper means provided between the door layer 234 and the rear enclosing wall 232 is preferred to be configured to be operable from both the exterior and the interior of the tent body 20. That is, the zipper means can be accessed and actuated by the user who is either outside the tent or already inside the camping cavity 24. This dual-sided operability is achieved through the use of double zipper pulls or equivalent mechanisms installed along the zipper track. Accordingly, the zipper means may comprise a zipper track formed by a pair of interlocking teeth strips, each attached to a respective edge portion of the door layer 234 and the rear enclosing wall 232 of the tent body 20. The interlocking teeth may be formed from plastic or metal and are configured to engage and disengage through the movement of a slider mechanism. The slider mechanism is preferably a dual-head zipper slider, meaning it includes two zipper pulls positioned on opposite sides of the slider body, one facing the exterior of the tent and the other facing the interior. This configuration allows the user to open or close the zipper from either side of the tent body 20.

Figure 4:
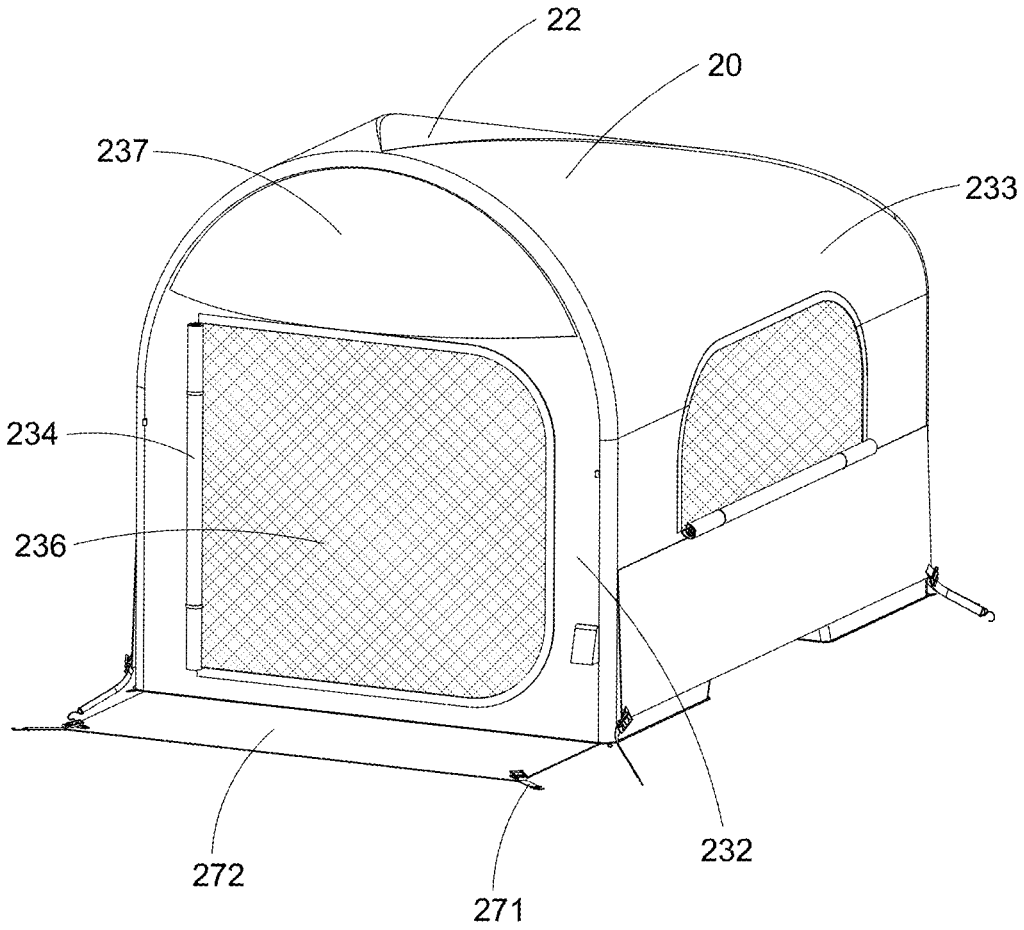
FIG. 4 is another perspective view of the easy setup camping tent according to the above preferred embodiment of the present invention, wherein a mesh layer behind the door layer is shown.
Figure 5:
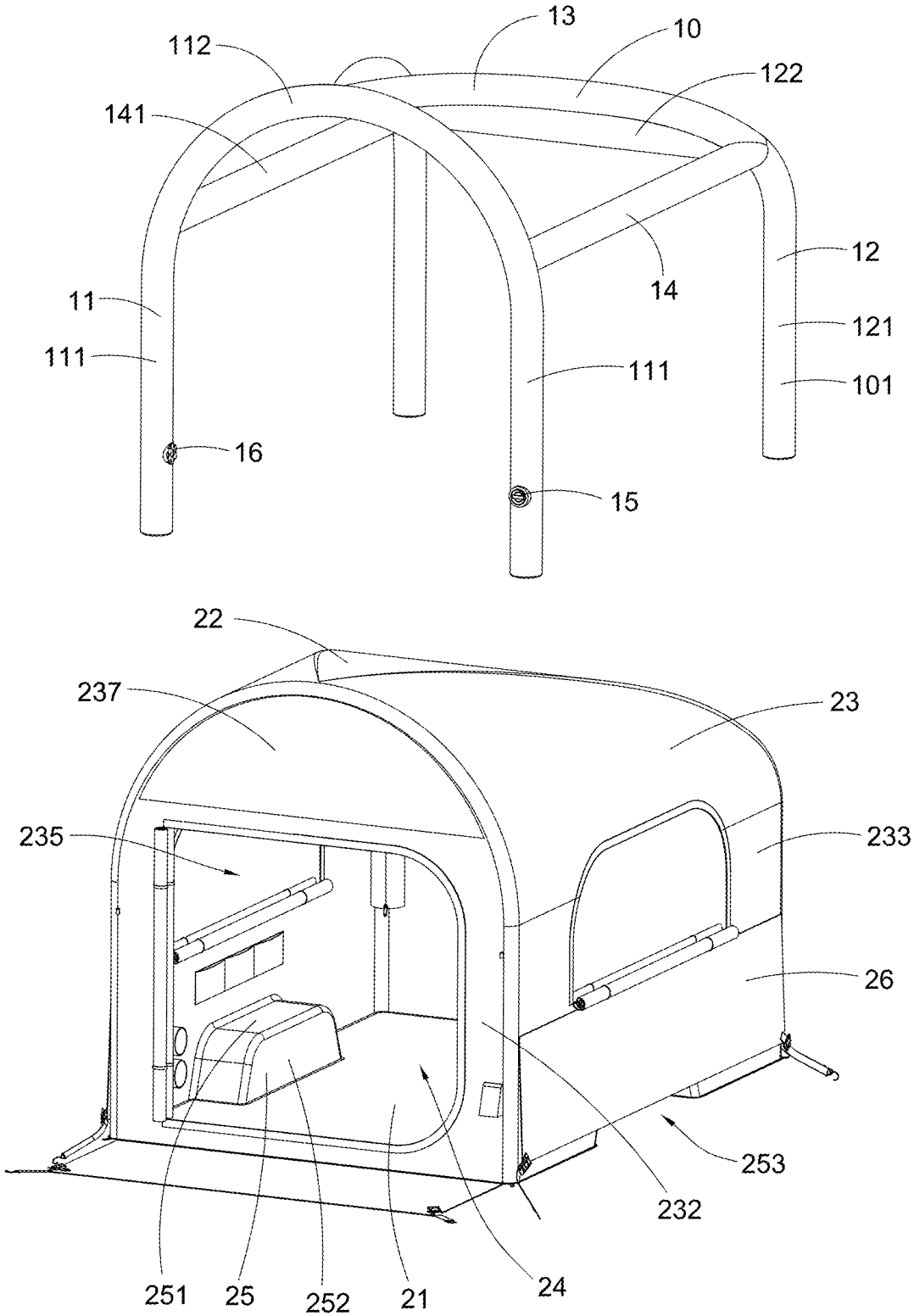
FIG. 5 is an exploded view of the easy setup camping tent according to the above preferred embodiment of the present invention.
Figure 6:
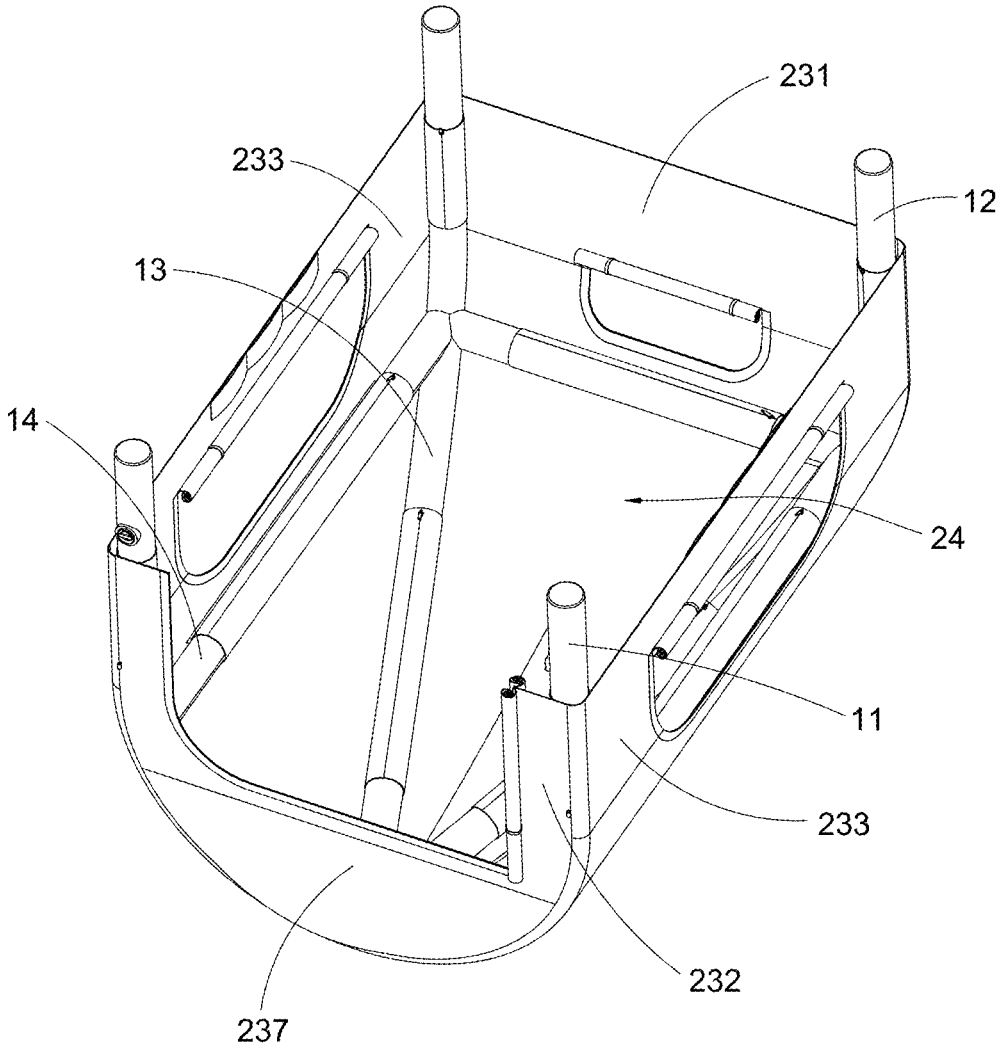
FIG. 6 is a bottom perspective view of the easy setup camping tent according to the above preferred embodiment of the present invention.
Figure 7:
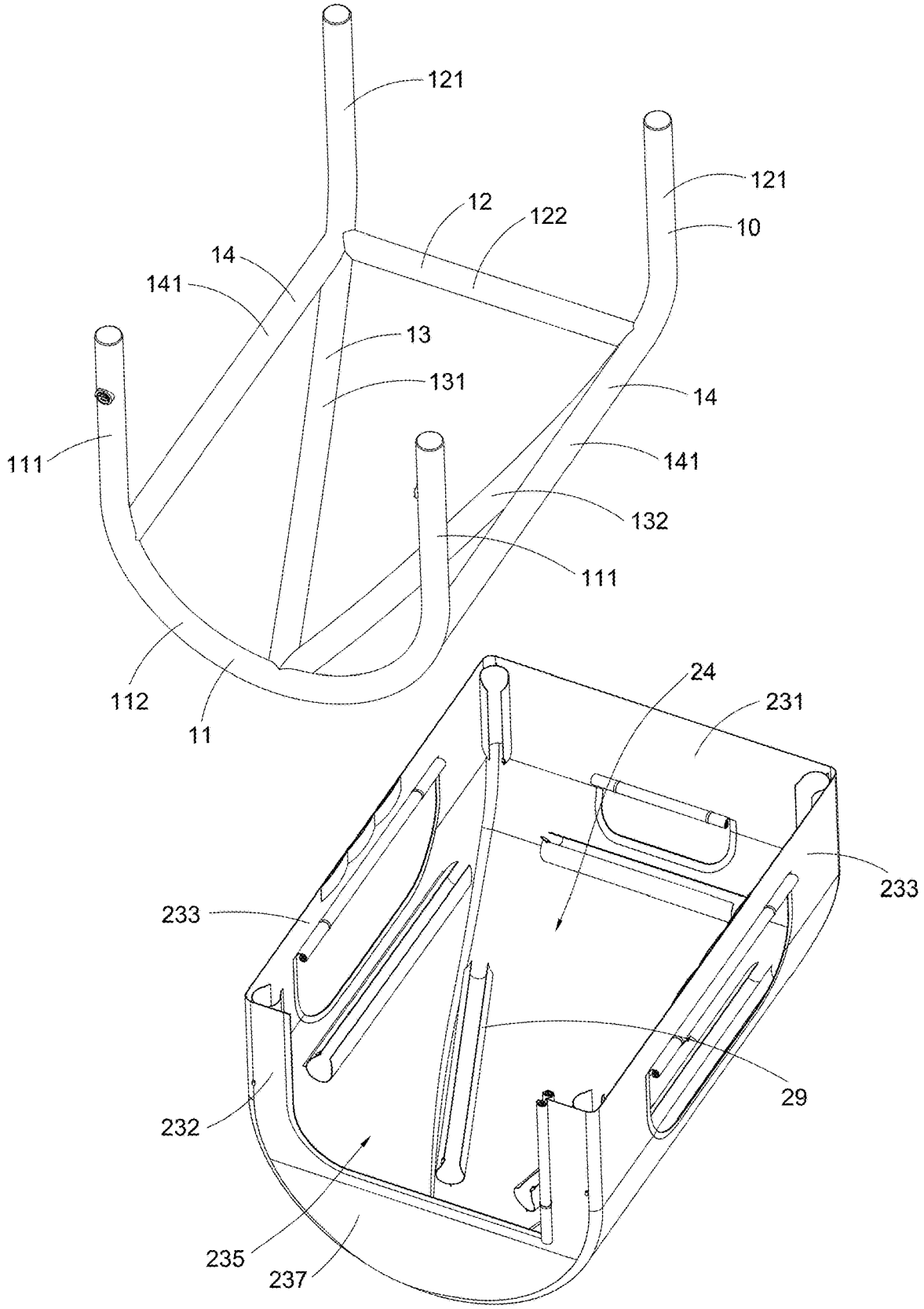
FIG. 7 and FIG. 8 are two other exploded views of the easy setup camping tent according to the above preferred embodiment of the present invention.
Figure 8:
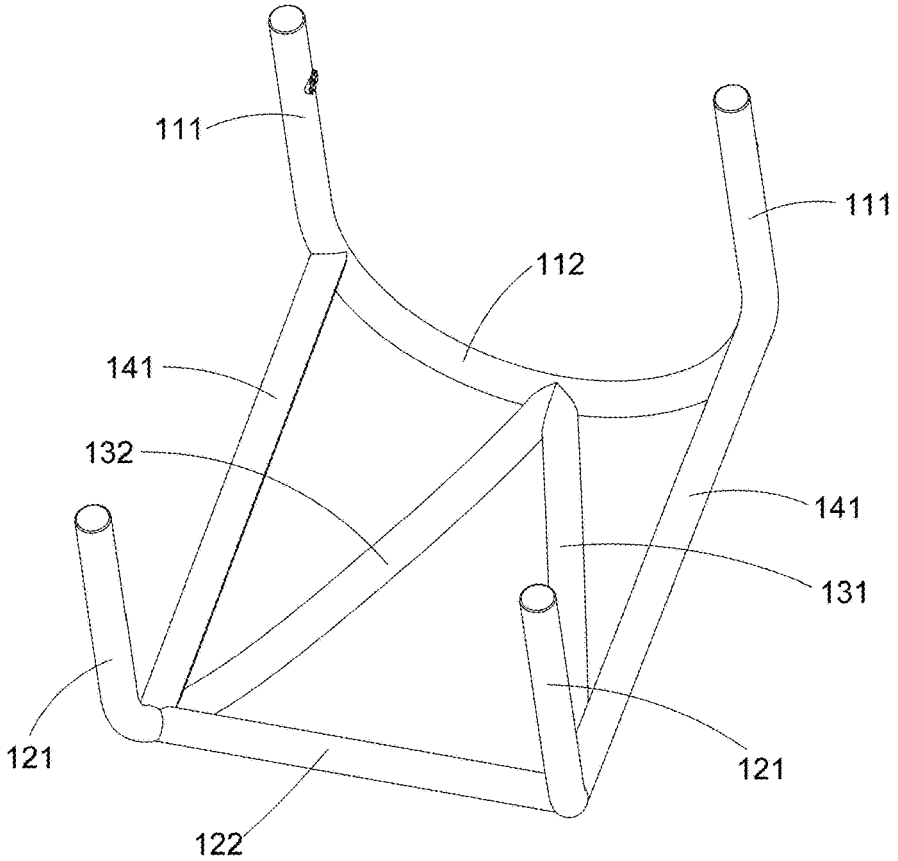
Figure 8:
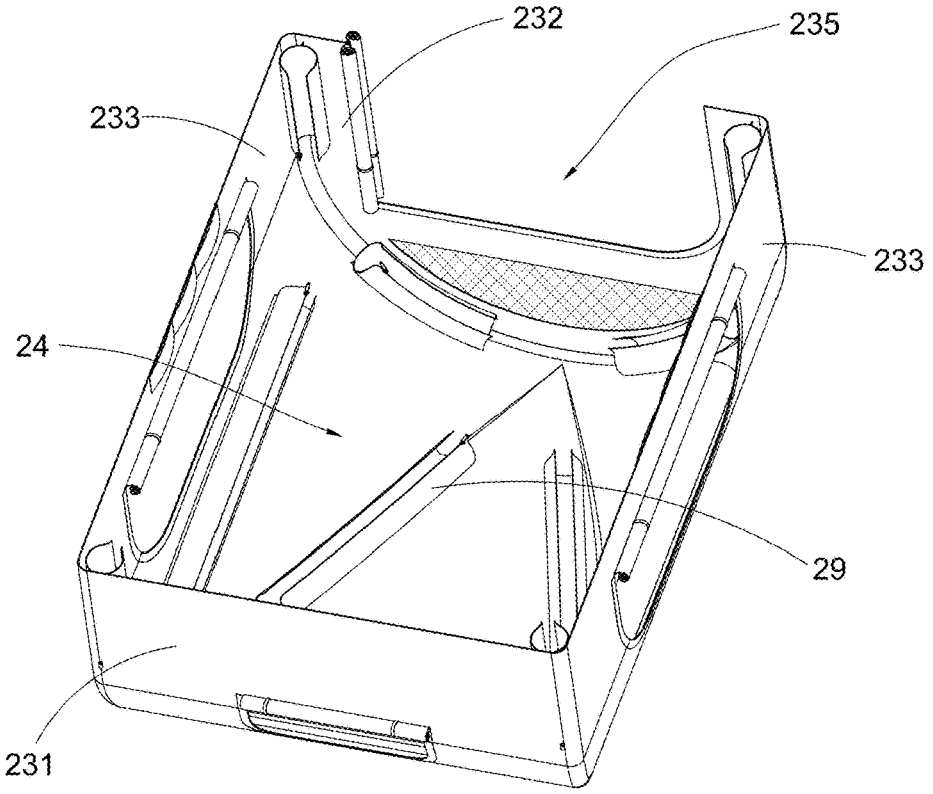
Figure 9:
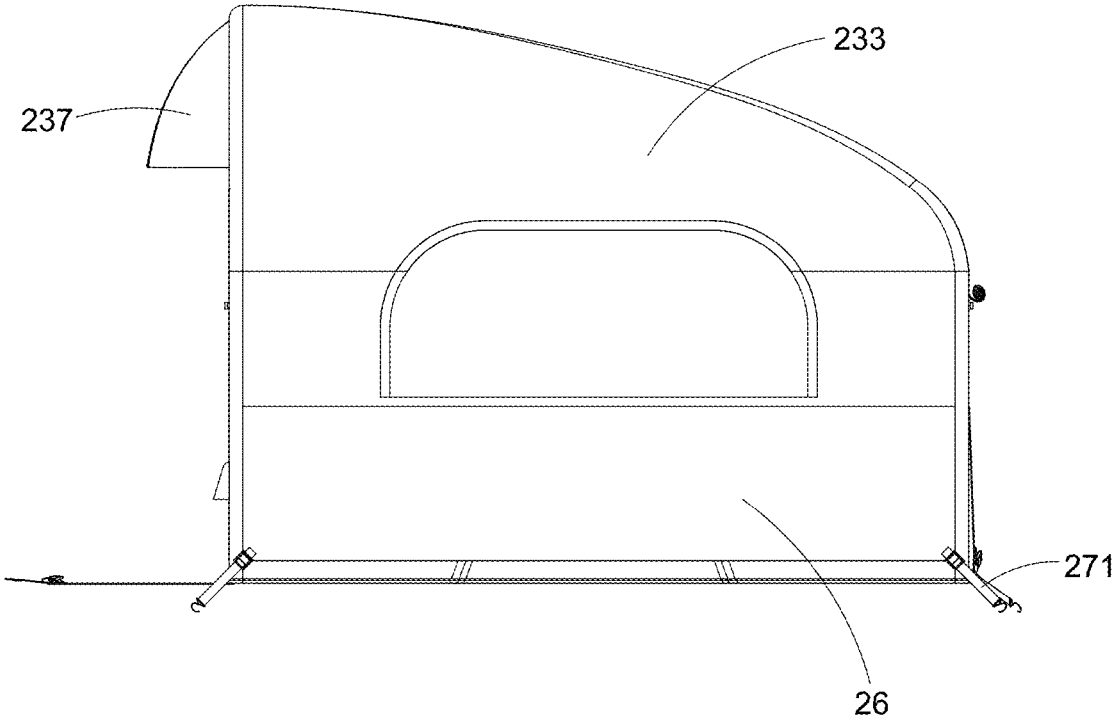
FIG. 9 is a side view of the easy setup camping tent according to the above preferred embodiment of the present invention.

As shown in FIG. 4 of the drawings, the enclosing layer 23 of the tent body 20 may further comprise a mesh wall 236 positioned at an inner side of the door layer 234. When the door layer 234 is in the opened state, the mesh wall 236 can be in the closed state so as to allow the ventilation of the camping cavity 24, thereby covering the access opening 235 while allowing airflow and ventilation into the camping cavity 24. The mesh wall 236 may be formed of a breathable, fine-gauge mesh fabric capable of preventing the entry of insects, leaves, or debris while permitting air circulation. A separate zipper or fastening mechanism may be included to open or secure the mesh wall 236 independently of the outer door layer 234.

Figure 13:
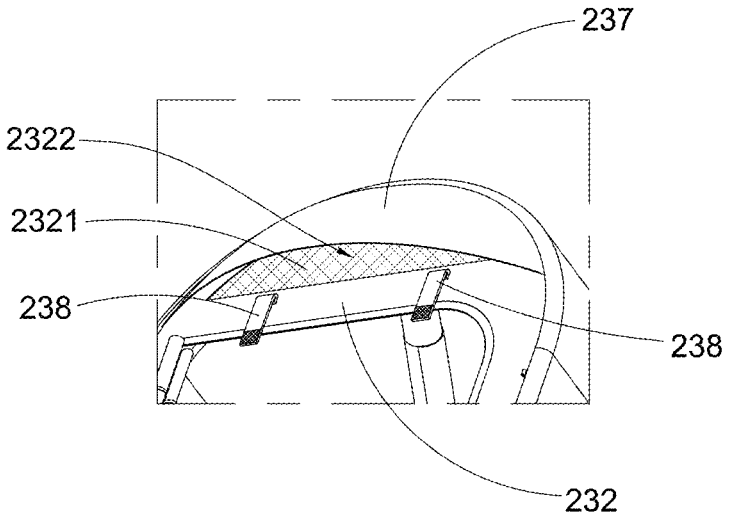
FIG. 13 is a perspective view illustrating an upper enclosing layer of the tent body of the easy setup camping tent according to the above preferred embodiment of the present invention.
Figure 14:
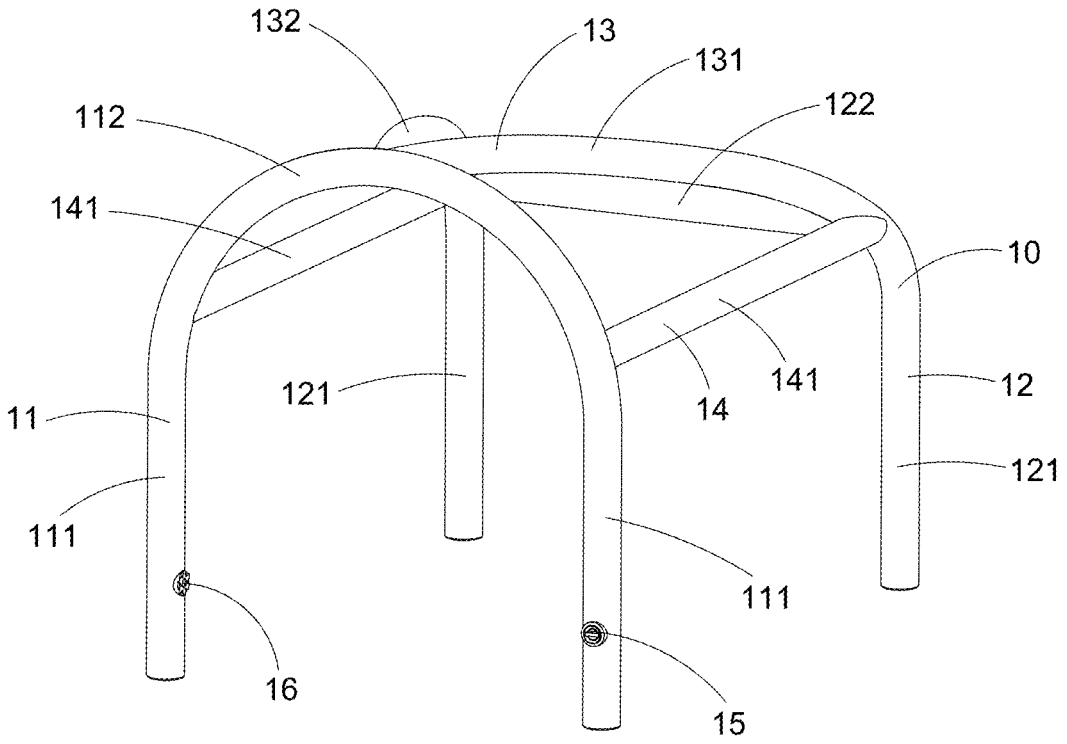
FIG. 14 is a perspective view illustrating an inflatable support assembly of the easy setup camping tent according to the above preferred embodiment of the present invention.
Figure 15:
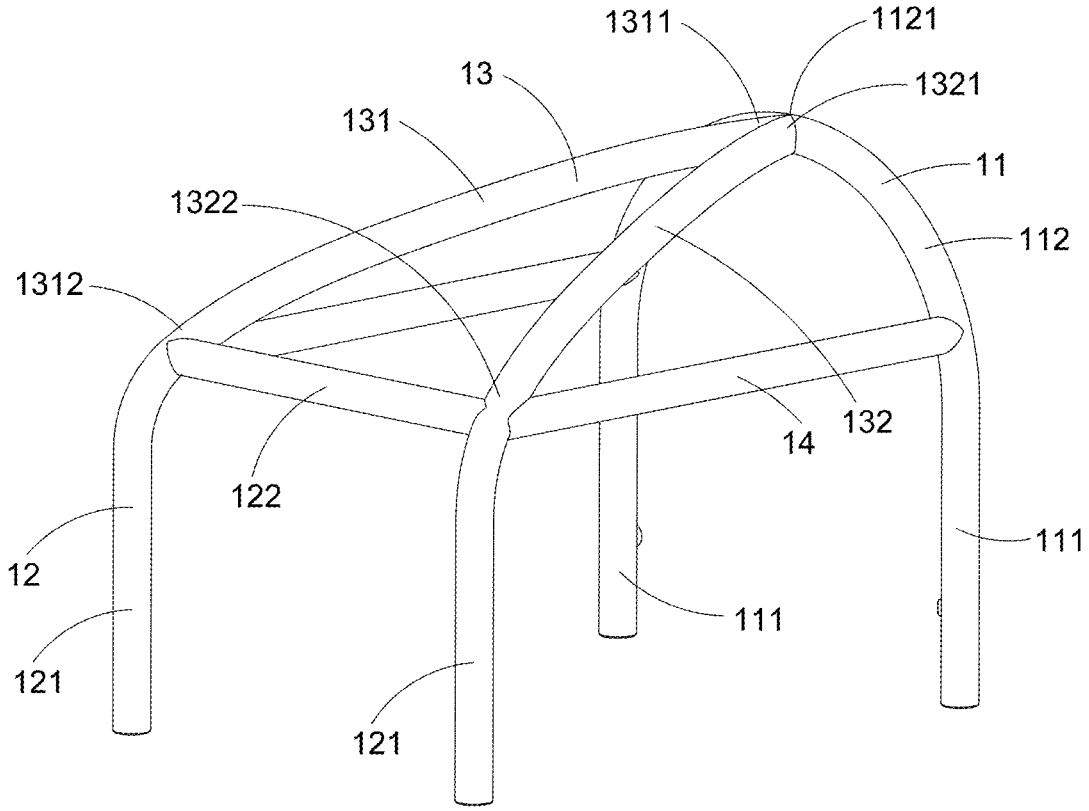
FIG. 15 is another perspective view illustrating the inflatable support assembly of the easy setup camping tent according to the above preferred embodiment of the present invention.
Figure 16:
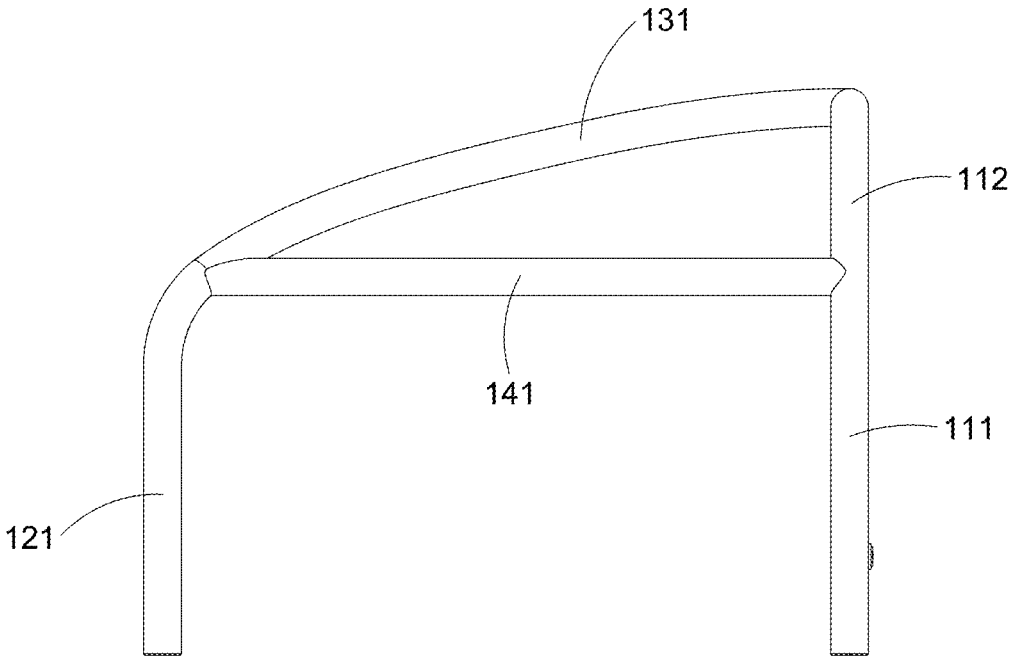
FIG. 16 is a side view illustrating the inflatable support assembly of the easy setup camping tent according to the above preferred embodiment of the present invention.
Figure 17:
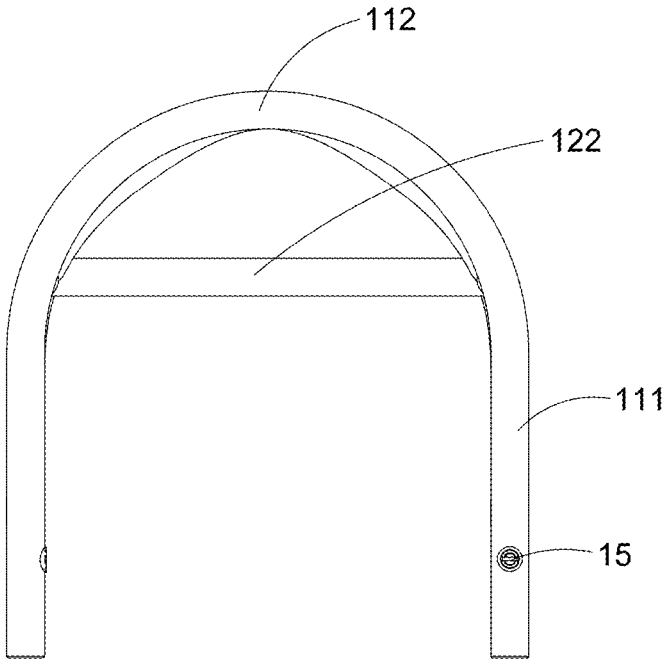
FIG. 17 is a rear view illustrating the inflatable support assembly of the easy setup camping tent according to the above preferred embodiment of the present invention.

As shown in FIGS. 12 and 13, the enclosing layer 23 of the tent body 20 may further comprise an upper enclosing wall 237 connected to a top edge of the rear enclosing wall 232 and is positioned above the door layer 234, the rear enclosing wall 232 comprises an upper end portion 2321 having one or more vent holes 2322, the upper enclosing wall 237 is covered on the upper end portion 2321 of the rear enclosing wall 232, one or more support struts 238 can be provided between the upper enclosing wall 237 and the upper end portion 2321 of the rear enclosing wall 232 to be in a transverse support state to allow the upper enclosing wall 237 and the upper end portion 2321 of the rear enclosing wall 237 to be spaced apart from each other to expose the vent holes 2322, so as to allow airflow and ventilation into the camping cavity 24 when the door layer 234 is in the closed state to close the access opening 235 when the user is sleeping in the tent body 20.

One end of each support strut 238 is fixed to one of the upper enclosing wall 237 and the upper end portion 2321 of the rear enclosing wall 232 while the other end thereof is detachably fixed to the other of the upper enclosing wall 237 and the upper end portion 2321 of the rear enclosing wall 232, so that when each support strut 328 is connected and supported between the upper enclosing wall 237 and the upper end portion 2321 of the rear enclosing wall 232 in the transverse support state, the upper enclosing wall 237 is in an inclined state, so as to create a gap between the upper enclosing wall 237 and the upper end portion 2321 of the rear enclosing wall 232.

In addition, the inclined upper enclosing wall 237 facilitates rainwater drainage by allowing water to slide off the surface of the upper enclosing wall 237 rather than accumulate on it, thereby preventing water pooling and maintaining the structural and functional integrity of the tent body 20, so that even with the vent holes 2322 being open, the overlapping upper enclosing wall 237 provides a protective overhang, preventing rainwater from entering the tent body 20. Accordingly, the inclined upper enclosing wall 237 not only supports effective passive ventilation through the vent holes but also serves as a water-shedding surface, thus combining airflow and weatherproofing in a single design.

The tent body 20 further comprises a plurality of shielding layers 26 which are mounted to and covered on the side walls 10022 of the truck bed 1002, so as to form protective flaps or skirts that are adapted to block or divert rainwater away from the base of the tent body 20. When rainwater flows down along the surface of the enclosing layer 23, the shielding layers 26 effectively channel the water away from the tent structure, reducing the likelihood of water ingress into the camping cavity 24. The shielding layers 26 help protect the lower seams and stitching from prolonged moisture exposure, thereby prolonging the lifespan of the tent body 20.

Figure 10:
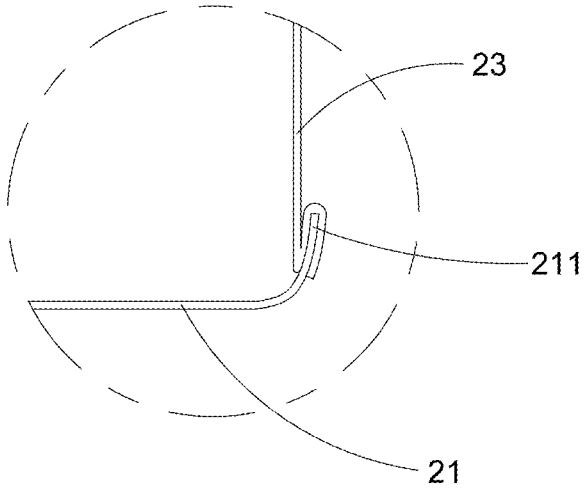
FIG. 10 is an enlarged view illustrating a peripheral flange of a tent body of the easy setup camping tent according to the above preferred embodiment of the present invention.

As shown in FIG. 10, the bottom layer 21 of the tent body 20 is formed with a peripheral flange 211 which is a turned-up edge along its outer boundary. This protective peripheral flange 211 is designed to extend upwardly at the junction where the bottom layer 21 is joined with the enclosing layer 23. The purpose of this peripheral flange 211 is to shield the seam or connection area between the bottom layer 21 and the enclosing layer 23 from abrasion, friction, or mechanical wear that may occur during setup, use, or transportation of the tent. By preventing direct exposure and contact with the ground or other abrasive surfaces, the peripheral flange 211 significantly reduces the risk of material fatigue or tearing at the seam, thereby preventing potential water ingress into the camping cavity 24.

The tent body 20 further comprises a fixing unit 27 which may comprise a plurality of fixing elements 271, such as hook elements, which can be fixed on the tent body 20 for fixing the tent body 20 to the pickup truck 1000. The fixing unit 27 may comprise a fixing layer 272, multiple hooks elements can be mounted to the fixing layer 272 for being hooked on the truck parts under the truck bed 1002. The fixing layer 272 can be connected to one of the bottom layer 21, the top layer 22 and the enclosing layer 23. In this embodiment, the fixing layer 272 is connected to the rear enclosing wall 232 at a position under the door layer 234. The fixing layer 272 can be covered on a rear end of the truck bed 1002 when easy setup camping tent is in the unfolded use state.

The tent body 20 is further equipped with air conditioning inlet and outlet ports 28 that are configured to connect to an external air conditioning unit. Specifically, at least one air inlet port and one air outlet port are integrally formed on the enclosing layer 23 of the tent body 20. These ports allow for bidirectional airflow, enabling cool or warm air to be directed into the camping cavity 24 and exhaust air to be expelled out efficiently.

The tent body 20 can be further equipped with one or more window layers, so as to allow the ten body 20 for defining one or more windows communicated to the camping cavity 24 if needed. A plurality of pockets may also be formed at an inner side of the enclosing layer 23 for the user to place his or her personal items. A plurality of O-rings may be provided in the tent body 20 for hanging LED lights, projectors, and other camping essentials, allowing the user to customize his or her own cozy mobile camping tent.

In this embodiment, as shown in FIGS. 14 to 17, the inflatable support assembly 10 comprises a rear frame 11, a front frame 12, a top frame 13 connected between the rear frame 11 and the front frame 12, and a frame connecting structure 14 connecting the rear frame 11 to the front frame 12. Preferably, the inflatable support assembly 10 comprises a plurality of air columns 101 which are integrated and interconnected with each other to form the rear frame 11, the front frame 12, the top frame 13 and the frame connecting structure 14. These air columns 101 may be fabricated from durable and airtight polymer materials, such as TPU (thermoplastic polyurethane) or PVC (polyvinyl chloride), and are designed to withstand repeated inflation and deflation without deformation or air leakage.

More specifically, the rear frame 11 comprises two rear stand columns 111 and a rear upper column 112 extended between the two rear stand columns 111, the rear upper column 112 can be a curved column which is integrally extended from two upper ends of the two rear stand columns 111, so that the rear frame 111 can be constructed to have an inverted U-shape. Actually, the rear frame 11 in this embodiment is an arch frame. Alternatively, the rear upper column 112 also can be a flat straight column horizontally and linearly extended between the two rear stand columns 111 when the rear frame 11 is inflated.

The front frame 12 comprises two front stand columns 121 and a front upper column 122 extended between the two front stand columns 121, the front upper column 122 can be a curved column which is integrally extended from two upper ends of the two front stand columns 121. In this embodiment, the front upper column 122 is embodied as a flat straight column horizontally and linearly extended between the two front stand columns 121 when the front frame 12 is inflated.

Figure 2:
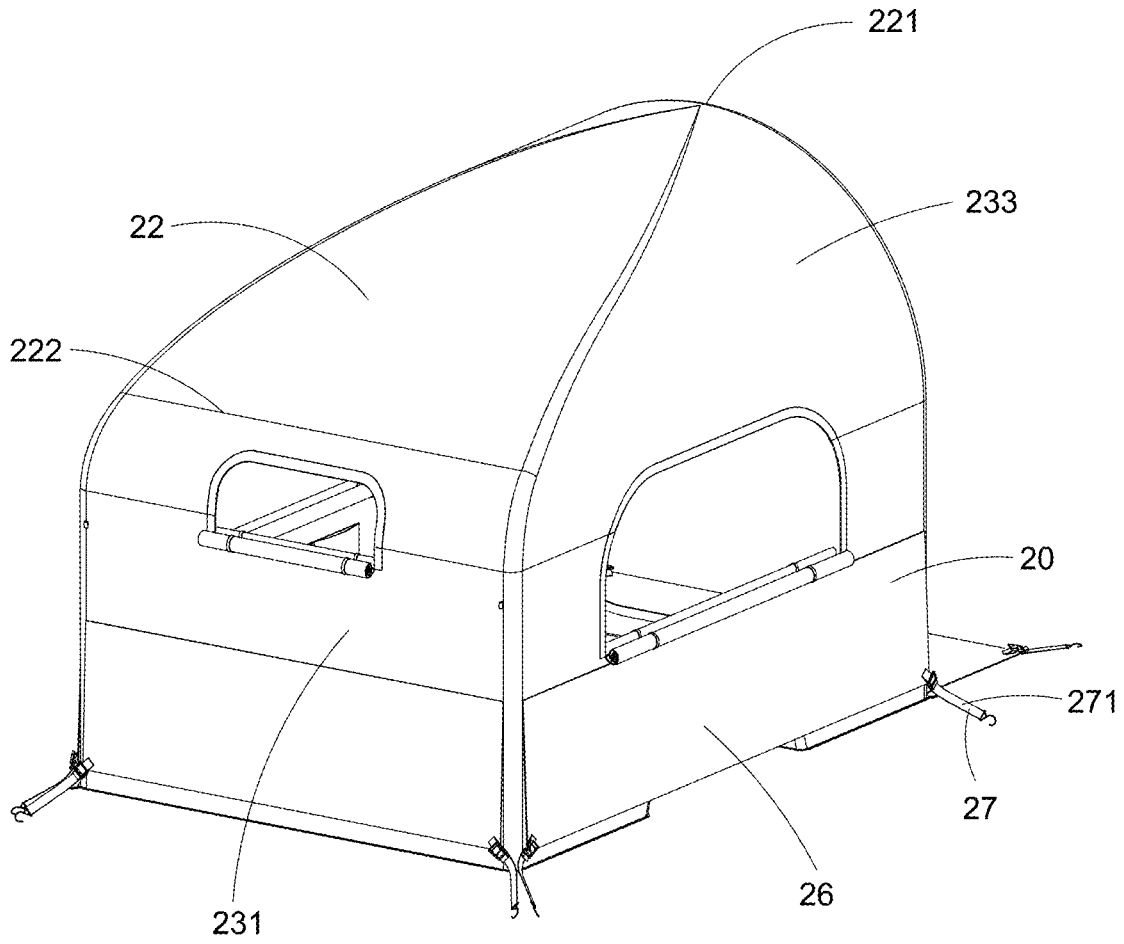
FIG. 2 is another perspective view of the easy setup camping tent according to the above preferred embodiment of the present invention.
Figure 3:
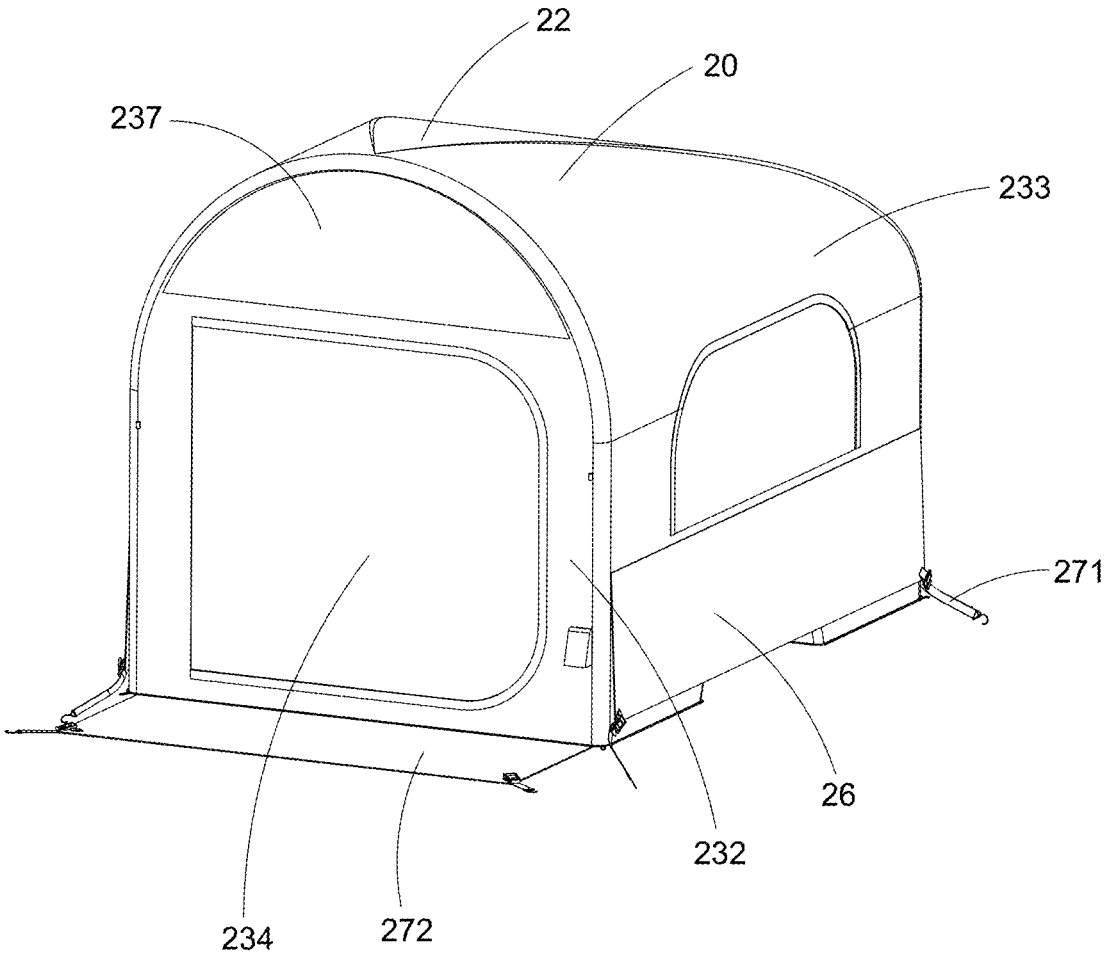
FIG. 3 is another perspective view of the easy setup camping tent according to the above preferred embodiment of the present invention, wherein an access opening communicated to the camping cavity is closed by a door layer.

In this embodiment, the rear upper column 112 has a top position 1121 which is higher than the front upper column 122, so that the top frame 13 connected between the rear upper column 112 of the rear frame 11 and the front upper column 122 of the front frame 12 is gradually slope downward along a direction from the rear frame 11 to the front frame 12 when the inflatable support assembly 10 is inflated, so that the top layer 22 of the tent body 20 covered on the top frame 13 will also be gradually slope downward along the direction from the rear frame 11 to the front frame 12 when the easy setup camping tent is in the unfolded, erected state. As shown in FIG. 2 of the drawings, the top layer 22 has a rear end 221 and a front end 222 which is lower than the rear end 221 in the unfolded state, a main body of the top layer 22 between the rear end 221 and the front end 222 is gradually slope downward along the direction from the rear frame 11 to the front frame 12.

The sloped configuration of the top layer 22 ensures that rainwater or condensation does not accumulate on the roof surface of the tent body 20. Instead, water is naturally directed downward toward the front side, thereby minimizing pooling, which could otherwise lead to leakage, sagging, or structural collapse over time.

The front side of the top layer 22, being lower than the rear side, is positioned closer to the cab 1001 of the pickup truck 1000 when the tent body 20 is mounted at the truck bed 1002. This orientation ensures that oncoming airflow (wind resistance) during vehicle movement impacts a lower surface of the tent roof, thereby reducing wind drag. This aerodynamic benefit contributes to improved fuel efficiency, reduced wind noise, and greater overall stability.

In this embodiment, the rear frame 11 is parallel with the front frame 12, the frame connecting structure 14 comprises two connecting columns 141 connected between the rear frame 11 and the front frame 12. The two connecting columns 141 can be parallel with each other, a rear end of each of the two connecting columns 141 can be connected to the fear frame 11, a portion of the rear frame above the two connecting columns 141 can be defined as the rear upper column 112. A front end of each of the two connecting columns 141 can be connected to a joint position between the rear stand column 121 and the rear upper column 122.

The top frame 13 comprises a first top column 131 and a second top column 132 which are connected between the rear upper column 112 of the rear frame 11 and the front upper column 122 of the front frame 12. In this embodiment, a rear end 1311 of the first top column 131 and a rear end 1321 of the second top column 132 can be connected to a same joint position of the rear upper column 112 of the rear frame 11, such as the top position 1121 of the rear upper column 112. A front end 1312 of the first top column 131 and a front end 1322 of the second top column 132 can be respectively connected to joint positions between the front upper column 122 and the front stand columns 121, so that the top frame 13 is embodied as a triangle frame, the top layer 22 of the tent body 20 is also can be shaped as a triangle layer.

Along the direction from the rear frame 11 to the front frame 12, both of the first top column 131 and the second top column 132 gradually slope downward, so that the top frame 13 forms a rear-high, front-low inclined roof structure. The use of a triangular frame enhances the mechanical stability of the top structure. Triangular configurations are inherently rigid, offering resistance to deformation under external loads such as wind or rain. The downward slope of the top columns from rear to front ensures efficient rainwater runoff, preventing accumulation of water on the top layer 22, which reduces risks of leakage, sagging, or tent collapse due to pooling. The forward slope of the top layer 22 creates a streamlined surface facing the cab 1001 of the pickup truck 1000, thereby reducing air resistance and minimizing drag.

Alternatively, the rear end 1311 of the first top column 131 and the rear end 1321 of the second top column 132 can be connected to different positions of the rear upper column 112 of the rear frame 11, so that the top frame may form a trapezoidal like configuration.

The rear frame 11 is mounted at an inner side of the rear enclosing wall 232 of the tent body 20, the front frame 12 is mounted at an inner side of the front enclosing wall 231 of the tent body 20, the top frame 13 is mounted under the top layer 22 of the tent body 20, the connecting columns 141 are mounted at the inner sides of the side enclosing walls 233 of the tent body 20.

The rear stand columns 111 of the rear frame 11 are respectively mounted to joint positions between the rear enclosing wall 232 and the side enclosing walls 233, forming the front corner support structure. The front stand columns 121 of the front frame 12 are respectively mounted to joint positions between the front enclosing wall 231 and the side enclosing walls 233, forming the front corner support structure. This arrangement ensures a stable rectangular footprint for the inflatable camping tent and enhances the integration of the inflatable support assembly 10 with the enclosing layer 23 of the tent body 20.

The first top column 131 and the second top column 132 can be arranged at joint positions between the top layer 22 and the two side enclosing walls 233. In other words, each of the first and second top columns 131 and 132 is positioned proximate to the upper corners where the top layer 22 transitions into the side enclosing walls 233. This arrangement provides structural support along the upper lateral edges of the tent body 20, reinforcing the tent shape and enhancing resistance to lateral wind forces or external loads acting on the roof portion.

The tent body 20 further comprises a plurality of mounting sleeves 29 which are respectively connected to the enclosing layer 23 or the top layer 22 of the tent body 20 for mounting the air columns 101 of the inflatable support assembly 10. Each mounting sleeve 29 can be provided with a detachable connecting means such as a zipper means for easy assembly between the air columns 101 of the inflatable support assembly 10 and the corresponding mounting sleeves 29.

The inflatable support assembly 10 further comprises an inflation valve 15 mounted on one air column 101 for inflating the inflatable support assembly 10 and a pressure relief valve 16 which is mounted on another air column 101 and is functioning as a safety device designed to release excess air when the internal pressure of the inflatable support assembly 10 reaches a preset limit. It helps prevent over-inflation and potential damage by automatically venting the excess pressure, ensuring safe and stable operation of inflatable structures or systems. As an example, the maximum inflation pressure of the pressure relief valve 16 can be set between 5 to 15 psi.

Figure 21A:
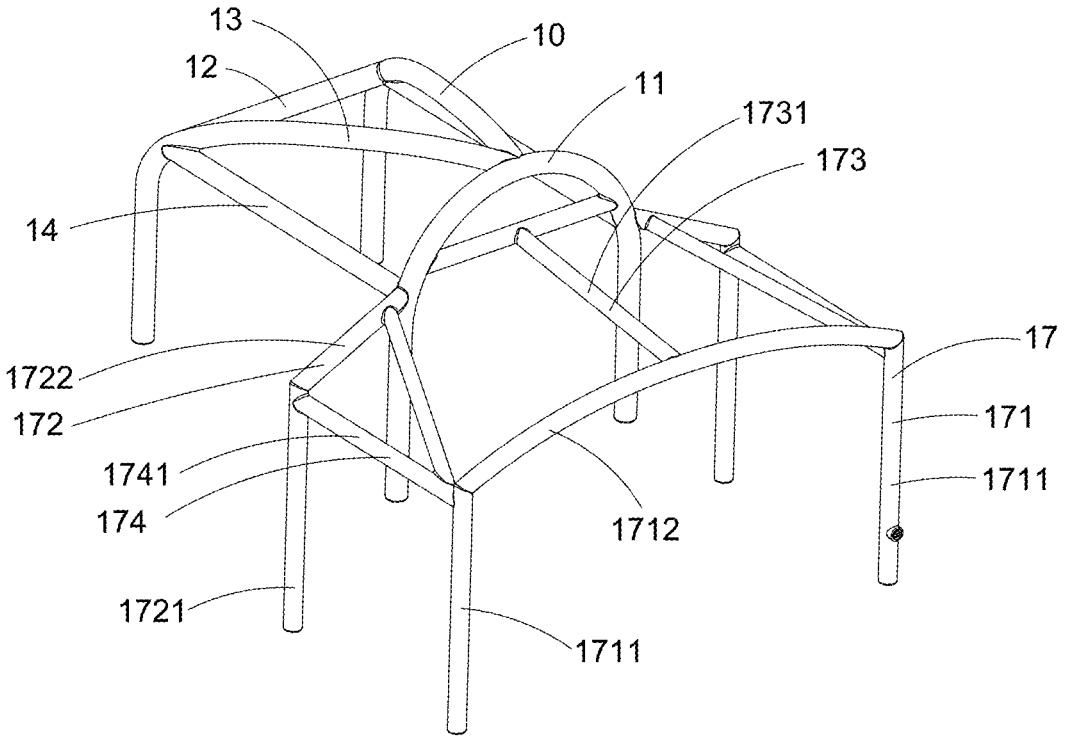
FIG. 21A is a perspective view illustrating an inflatable support assembly of an easy setup camping tent according to a first alternative mode of the above preferred embodiment of the present invention.
Figure 21B:
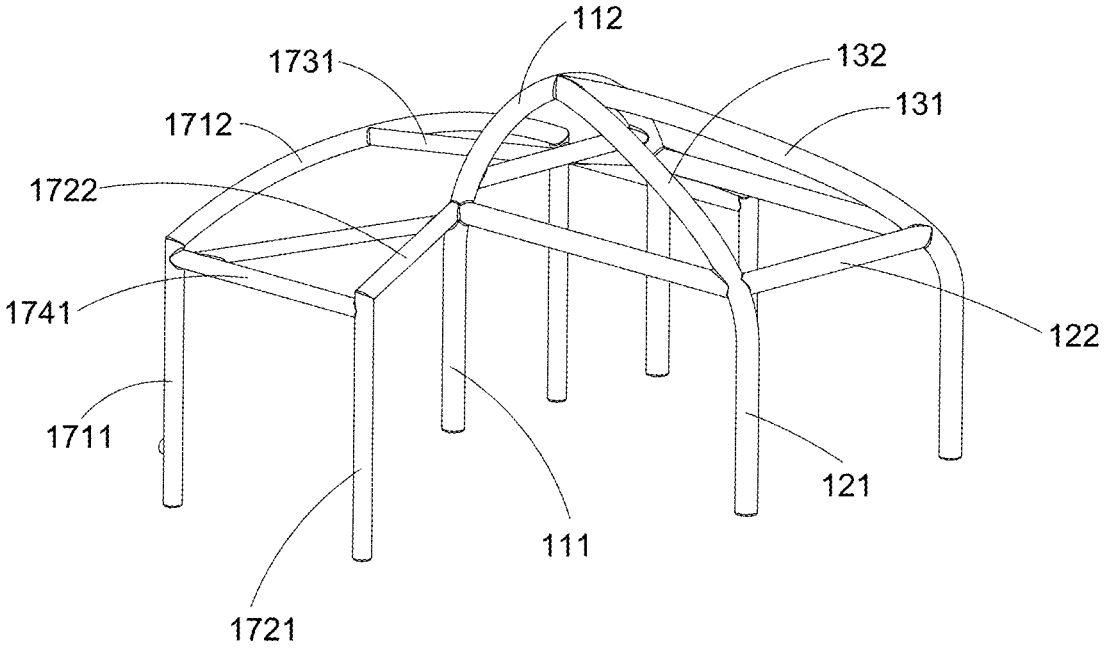
FIG. 21B is another perspective view illustrating the inflatable support assembly of the easy setup camping tent according to the first alternative mode of the above preferred embodiment of the present invention.
Figure 21C:
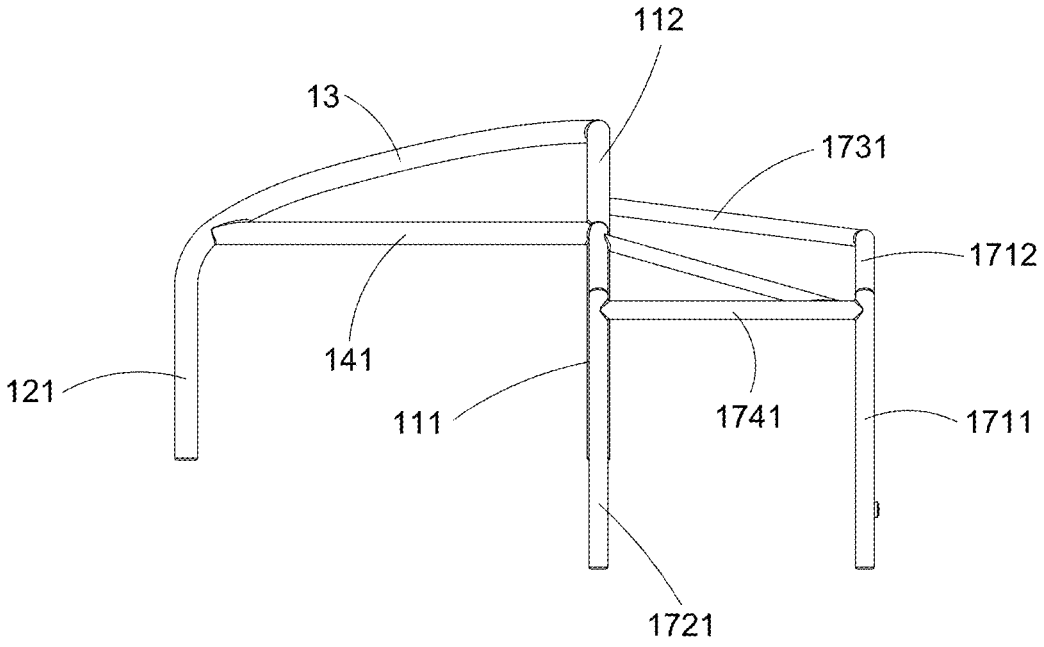
FIG. 21C is a side view illustrating the inflatable support assembly of the easy setup camping tent according to the first alternative mode of the above preferred embodiment of the present invention.
Figure 22:
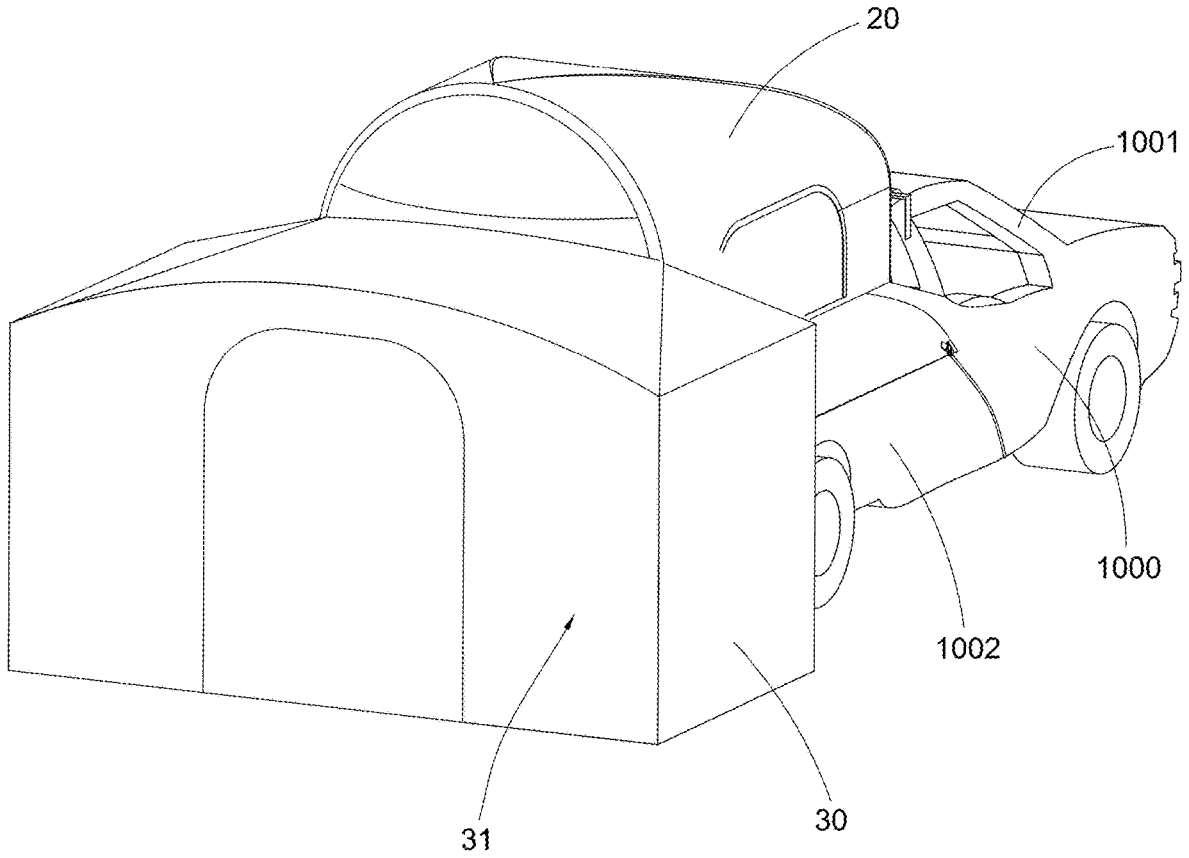
FIG. 22 is a perspective view illustrating an auxiliary tent of the easy setup camping tent according to the first alternative mode of the above preferred embodiment of the present invention.

Referring to FIGS. 21A to 22 of the drawings, an easy setup camping tent according to a first alternative mode of the above embodiment of the present invention is illustrated, the inflatable support assembly 10 according to the first alternative mode comprises the above rear frame 11, the front frame 12, the top frame 13, the frame connecting structure 14, and an auxiliary frame unit 17 connected to the rear frame 11. The easy setup camping tent further comprises an auxiliary tent 30 connected to the tent body 20 to define an auxiliary camping cavity 31 which can be communicated to the camping cavity 24.

The auxiliary frame unit 17, which is arranged to support the auxiliary tent 30, may comprise an auxiliary rear frame 171, an auxiliary front frame 172, an auxiliary top frame 173 and an auxiliary frame connecting structure 174. The auxiliary frame unit 17 can be inflated independently, or can be integrally connected to the rear frame 11, so that the auxiliary frame unit 17 can be inflated along with the rear frame 11, the front frame 12, the top frame 13, and the frame connecting structure 14.

The auxiliary rear frame 171 comprises two auxiliary rear stand columns 1711 and an auxiliary rear upper column 1712 connected between the two auxiliary rear stand columns 1711. Each auxiliary rear stand column 1711 which is arranged to be standing on the ground while each rear stand column 111 is arranged to be standing on the floor wall 10021 of the truck bed 1002. Accordingly, when the inflatable support assembly 10 is inflated for use, a bottom of the auxiliary rear frame 171 is arranged at a position lower than a bottom of the rear frame 11.

The auxiliary front frame 172 comprises two auxiliary front stand columns 1721 and two auxiliary front upper columns 1722 connected between the corresponding auxiliary front stand column 1711 and the rear frame 11. Each auxiliary front upper column 1722 is extended transversely from the corresponding rear stand column 111, and the auxiliary camping cavity 31 beside the pickup truck 1000 can have a larger volume and size than the camping cavity 24 in the tent body 20. When the inflatable support assembly 10 is inflated for use, a bottom of the auxiliary front frame 172 is arranged at a position lower than a bottom of the front frame 12.

The auxiliary top frame 173 may comprise one or more auxiliary top columns 1731 connected between the auxiliary rear frame 171 and the auxiliary front frame 172. The auxiliary frame connecting structure 174 may comprise a plurality of auxiliary connecting columns 1741 connected between the auxiliary rear stand columns 1711 and the auxiliary front stand columns 1721.

Figure 23:
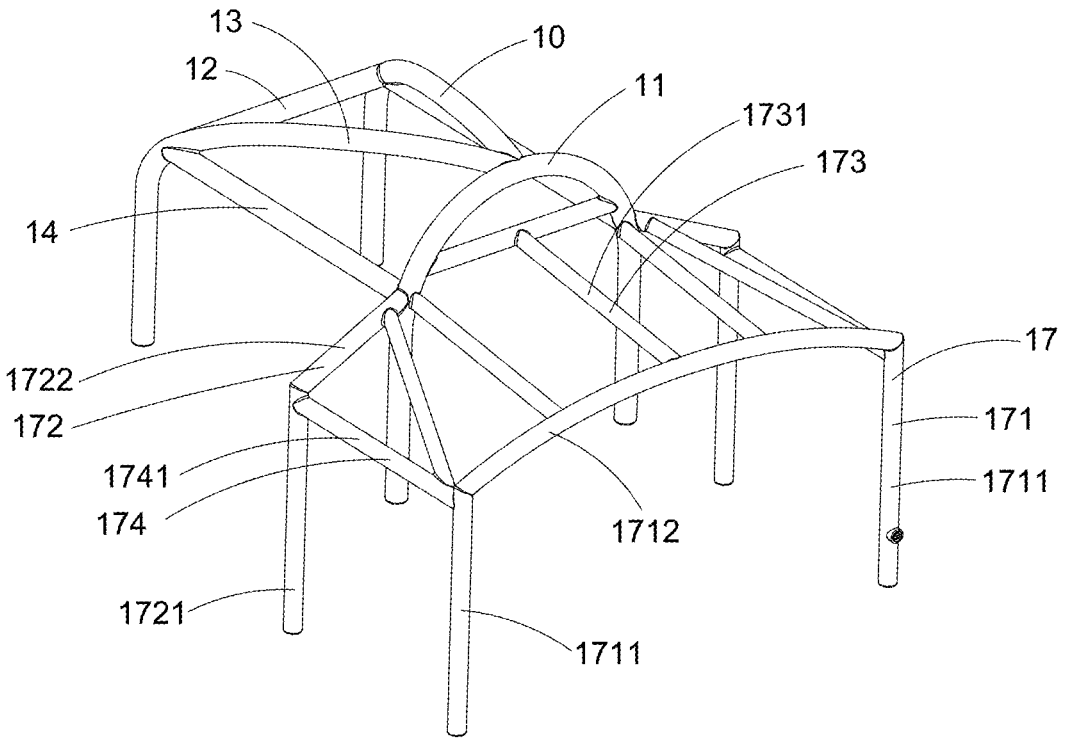
FIG. 23 is a perspective view illustrating an inflatable support assembly of an easy setup camping tent according to a second example of the first alternative mode of the above preferred embodiment of the present invention.
Figure 24A:
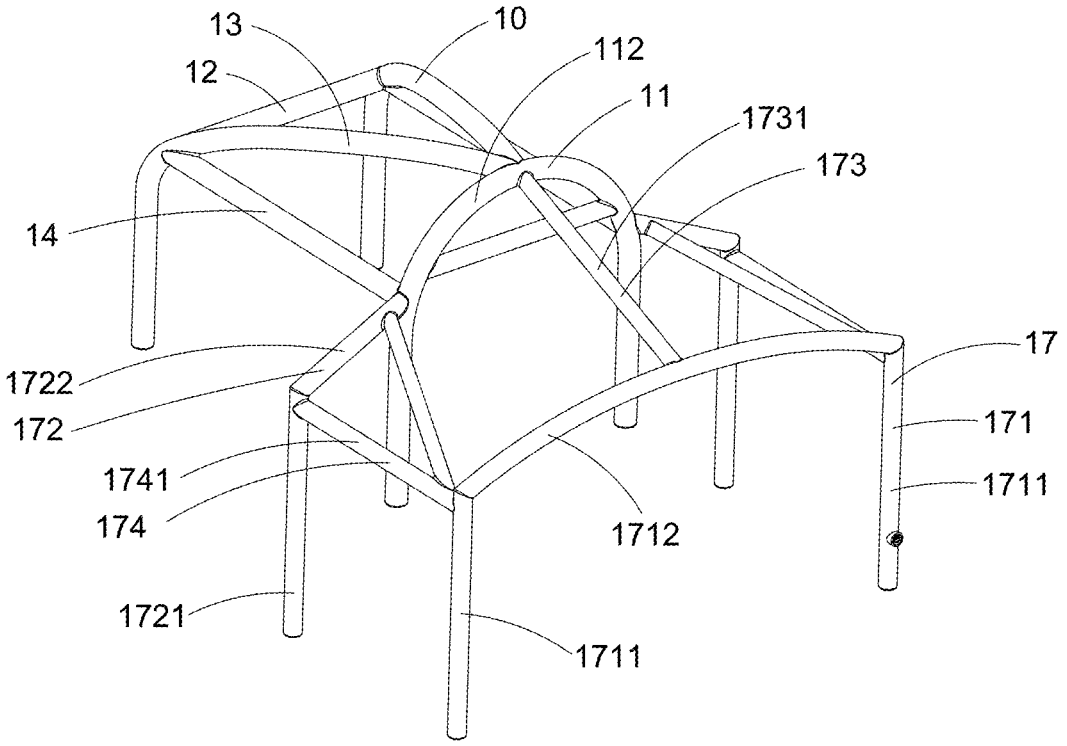
FIG. 24A is a perspective view illustrating an inflatable support assembly of an easy setup camping tent according to a third example of the first alternative mode of the above preferred embodiment of the present invention.
Figure 24B:
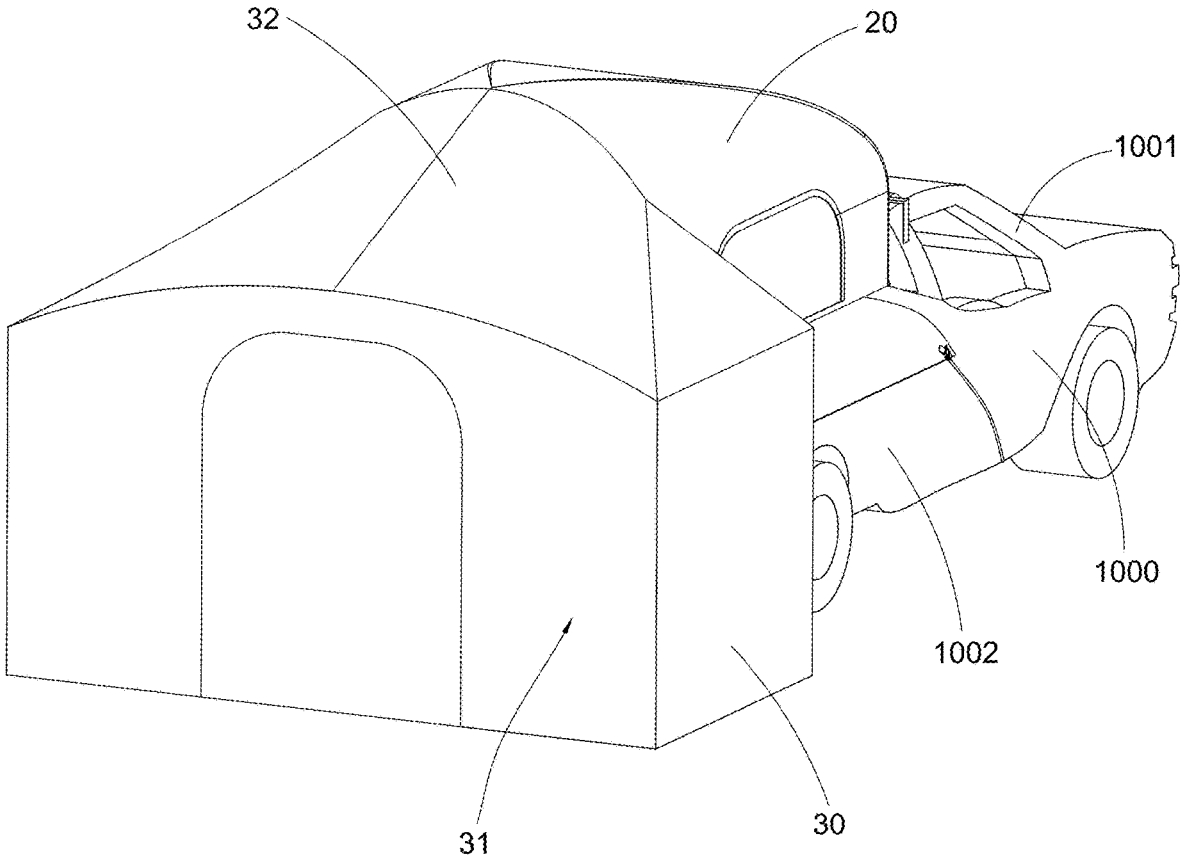
FIG. 24B is a perspective view illustrating the auxiliary tent and the inflatable support assembly of the easy setup camping tent according to the third example of the first alternative mode of the above preferred embodiment of the present invention.

As a second example, as shown in FIG. 23, a plurality of parallel auxiliary top columns 1731 can be connected between the auxiliary rear frame 171 and the auxiliary front frame 172. As a third example, as shown in FIGS. 24A to 24B, at least one auxiliary top column 1731 is connected between the rear upper column 112 and the auxiliary rear upper column 1712, and along the direction from the rear frame 11 to the auxiliary rear frame 171, the at least one auxiliary top column 1731 gradually slopes downward, so as to allow an auxiliary top layer 32 of the auxiliary tent 30 to gradually slope downward when the inflatable support assembly 10 is inflated.

Figure 25:
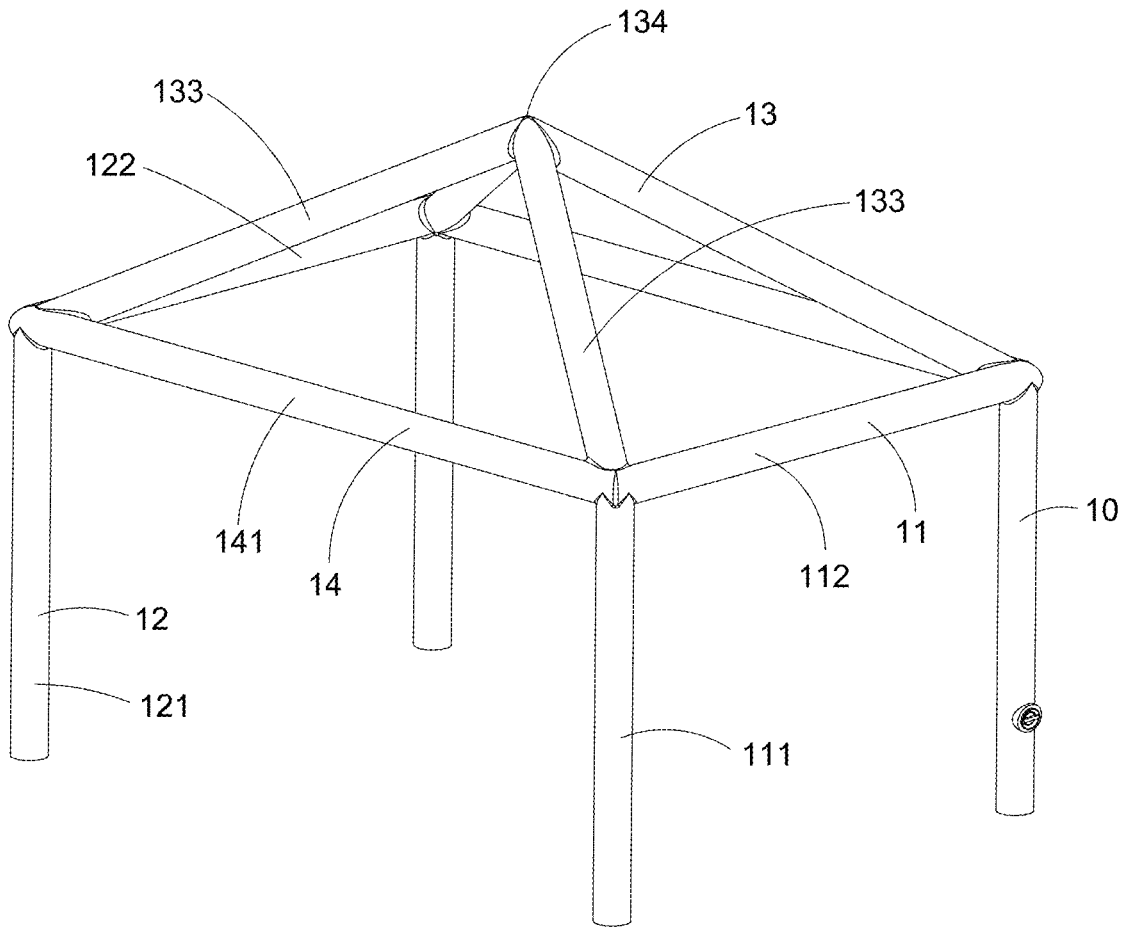
FIG. 25 is a perspective view illustrating an inflatable support assembly of an easy setup camping tent according to a second alternative mode of the above preferred embodiment of the present invention.
Figure 26:
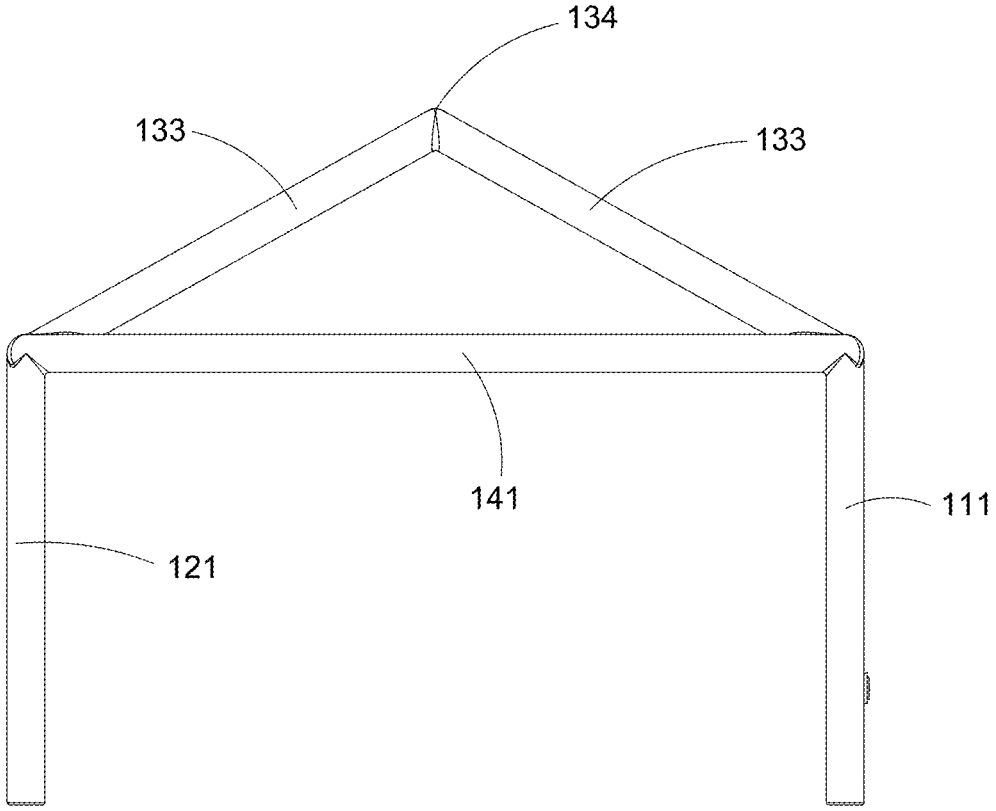
FIG. 26 is a side view illustrating the inflatable support assembly of the easy setup camping tent according to the second alternative mode of the above preferred embodiment of the present invention.

Referring to FIG. 25 and FIG. 26 of the drawings, an inflatable support assembly 10 according to a second alternative mode of the above embodiment of the present invention is illustrated, the inflatable support assembly 10 comprises a rear frame 11, a front frame 12, a top frame 13 connected between the rear frame 11 and the front frame 12, and a frame connecting structure 14 connecting the rear frame 11 to the front frame 12. More specifically, the rear frame 11 comprises two rear stand columns 111 and a rear upper column 112 which is embodied as a horizontal column extended between the two rear stand columns 111 when the inflatable support assembly 10 is inflated. Actually, the rear frame 11 in this embodiment is a flat arch frame. The front frame 12 comprises two front stand columns 121 and a front upper column 122 which can be a horizontal column extended between the two front stand columns 121 when the inflatable support assembly 10 is inflated. The frame connecting structure 14 comprises two connecting columns 141 connected between the rear frame 11 and the front frame 12.

In this embodiment, the top frame 13 comprises a plurality of radial top columns 133 which are radially extended between the rear frame 11 and the front frame 12. The radial top columns 133 are connected to and extended from a connecting position 134 which can be located in a center area of the top frame 13. When the inflatable support assembly 10 is inflated, the connecting position 134 can be located at the highest position, the radial top columns 133 gradually slopes downward from the connecting position 134.

Figure 27:
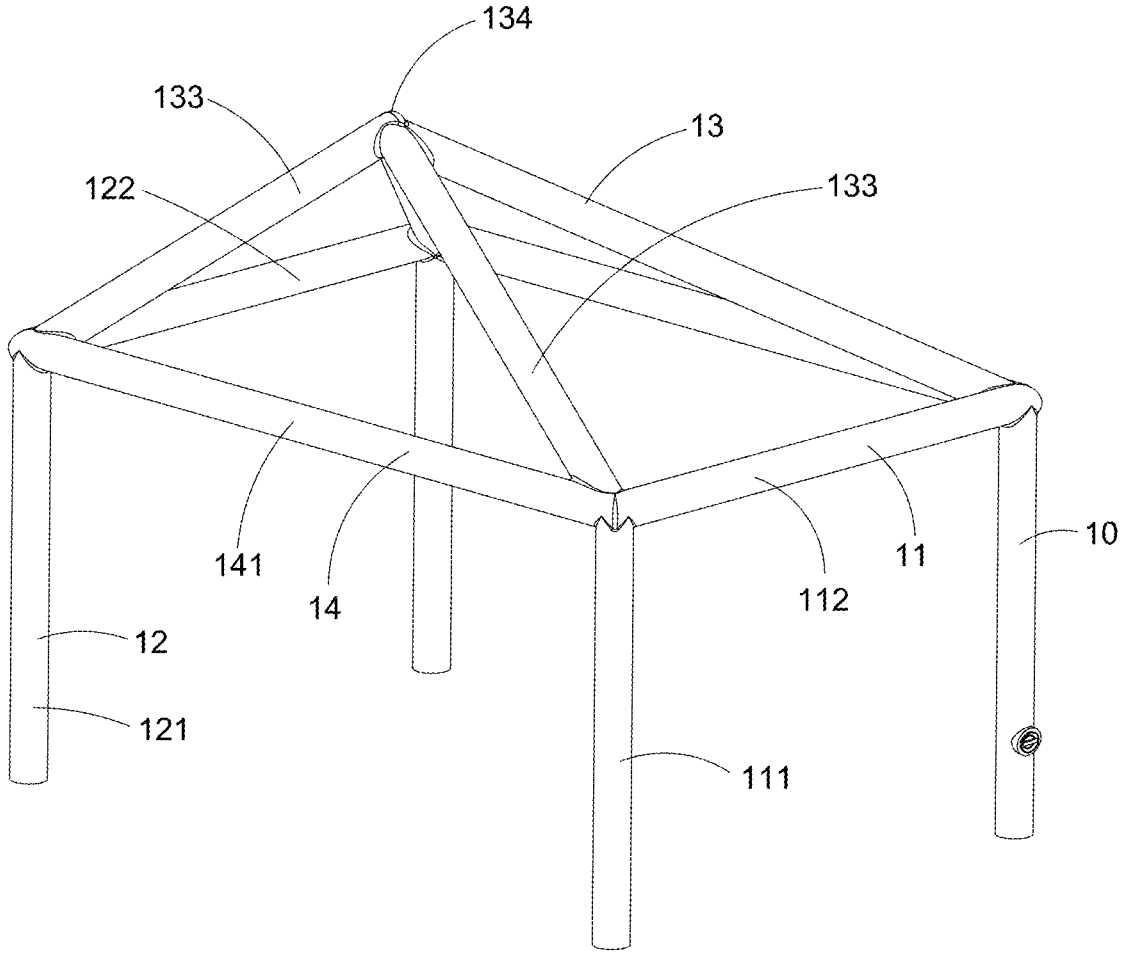
FIG. 27 is a perspective view illustrating an inflatable support assembly of an easy setup camping tent according to a third alternative mode of the above preferred embodiment of the present invention.
Figure 28:
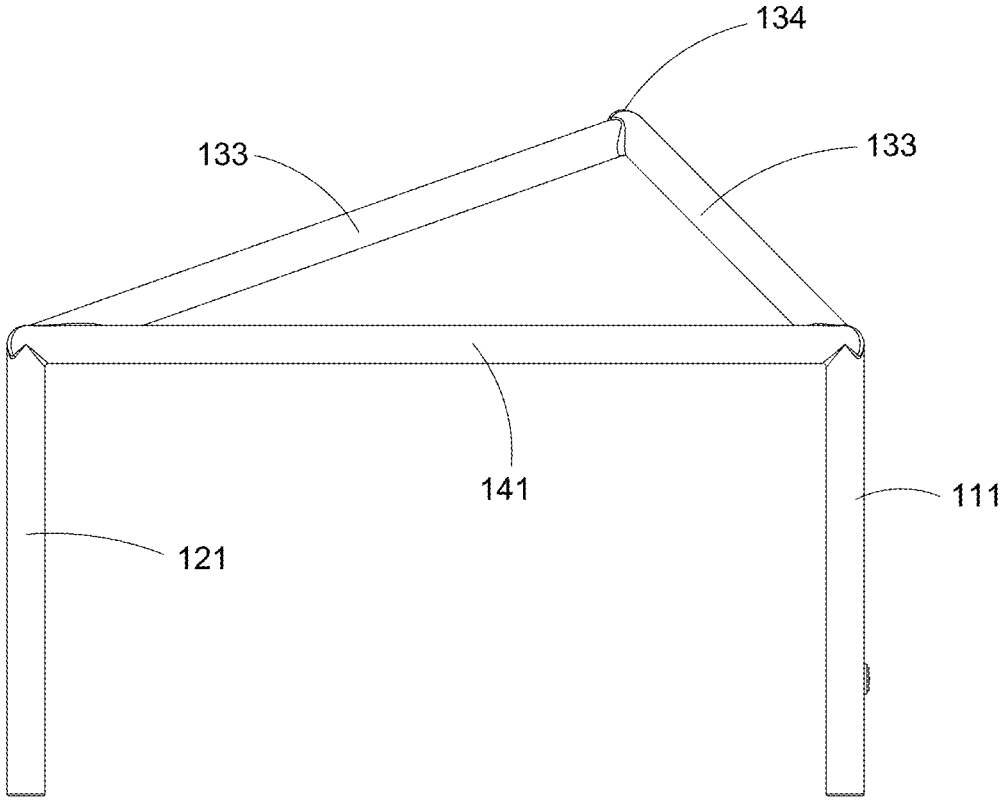
FIG. 28 is a side view illustrating the inflatable support assembly of the easy setup camping tent according to the third alternative mode of the above preferred embodiment of the present invention.

Referring to FIG. 27 and FIG. 28 of the drawings, an inflatable support assembly 10 according to a third alternative mode of the above embodiment of the present invention is illustrated, the connecting position 134 of the radial top columns 133 is located adjacent to rear frame 11 and is away from the front frame 12, so that the top layer 22 of the tent body 20 can form a rear-high, front-low sloped surface. This structure naturally promotes aerodynamic flow, thereby reducing wind resistance when the pickup truck 1000. The radial sloping arrangement helps to direct rainwater from the higher rear portion toward the lower front edges, minimizing water pooling on the top surface of the top layer 22 of the tent body 20.

Figure 29:
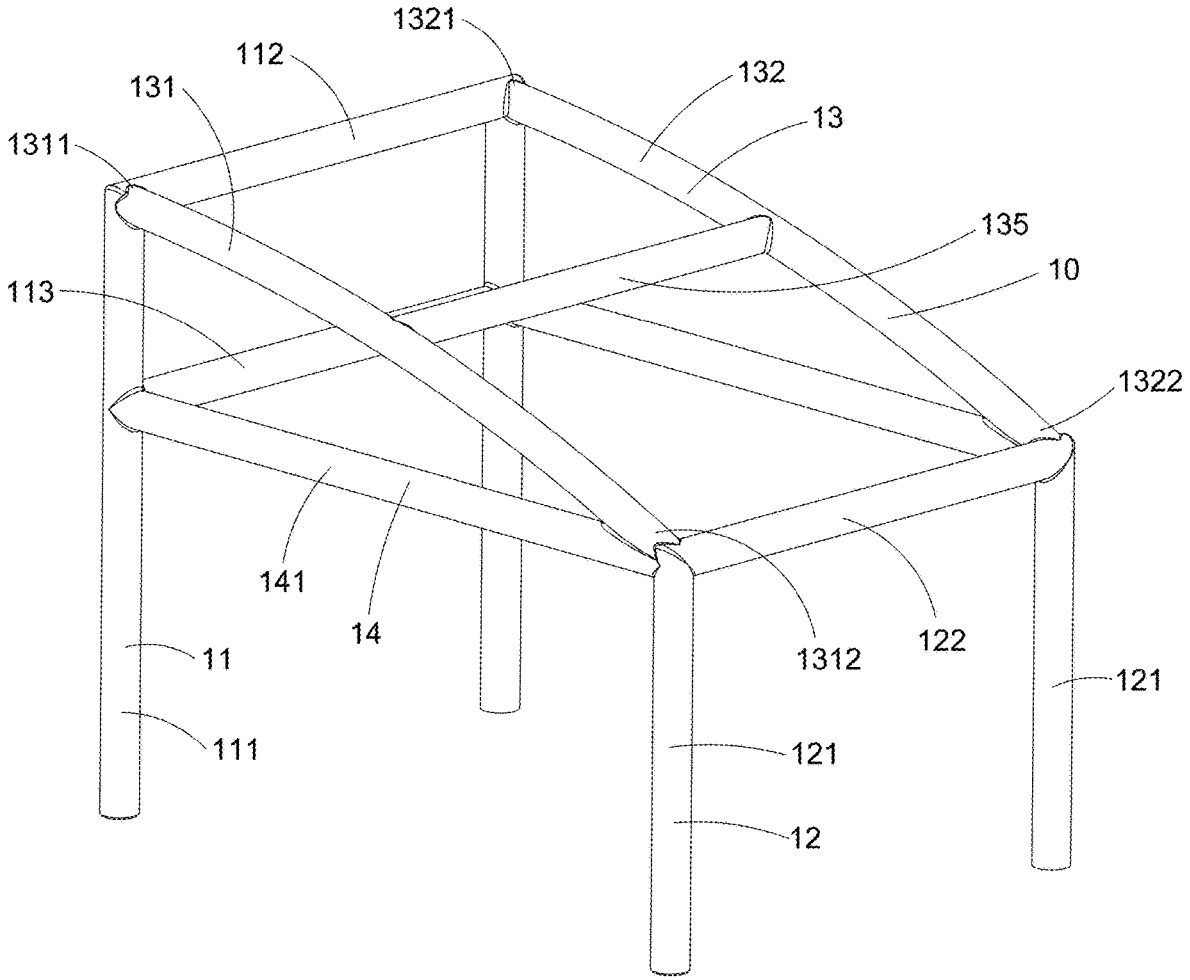
FIG. 29 is a perspective view illustrating an inflatable support assembly of an easy setup camping tent according to a fourth alternative mode of the above preferred embodiment of the present invention.
Figure 30:
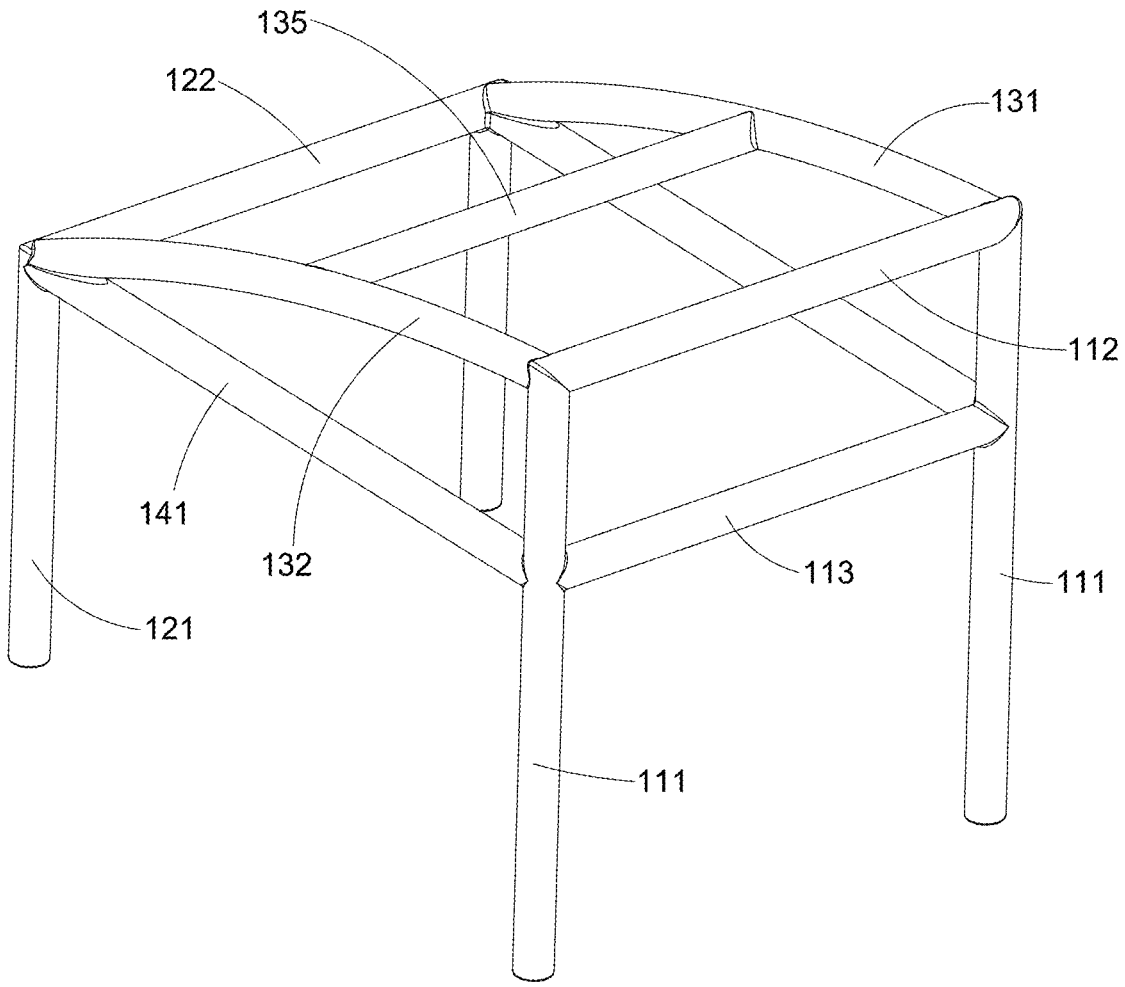
FIG. 30 is another perspective view illustrating the inflatable support assembly of the easy setup camping tent according to the fourth alternative mode of the above preferred embodiment of the present invention.
Figure 31:
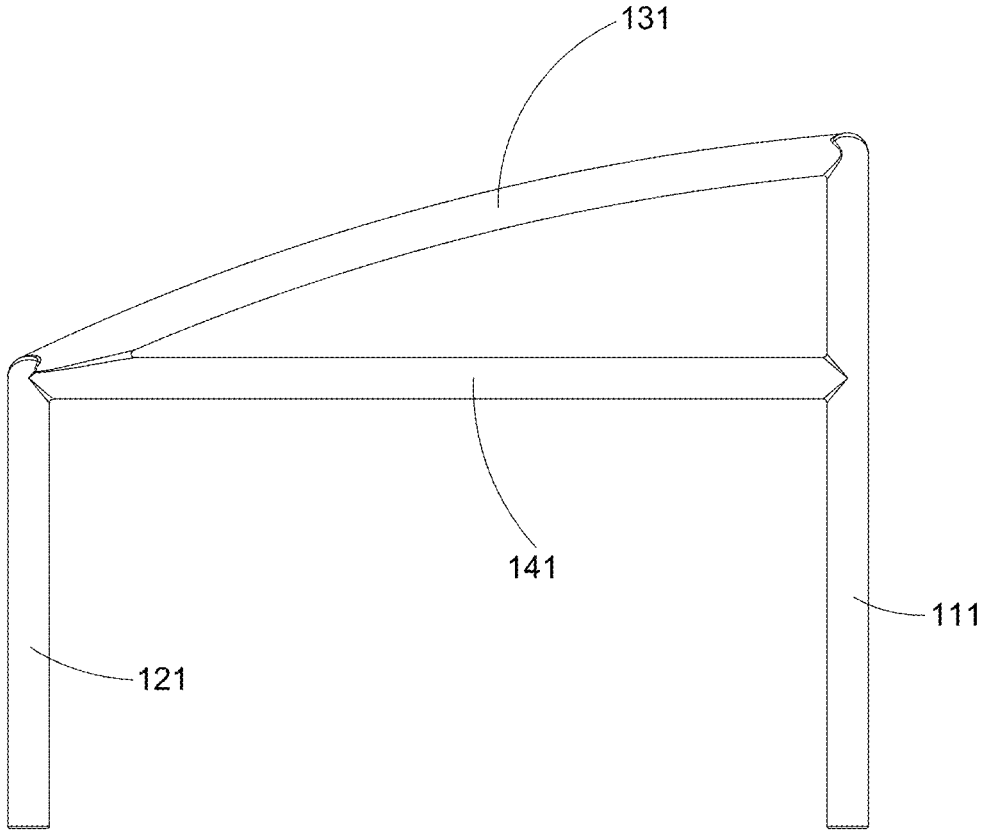
FIG. 31 is a side view illustrating the inflatable support assembly of the easy setup camping tent according to the fourth alternative mode of the above preferred embodiment of the present invention.
Figure 32:
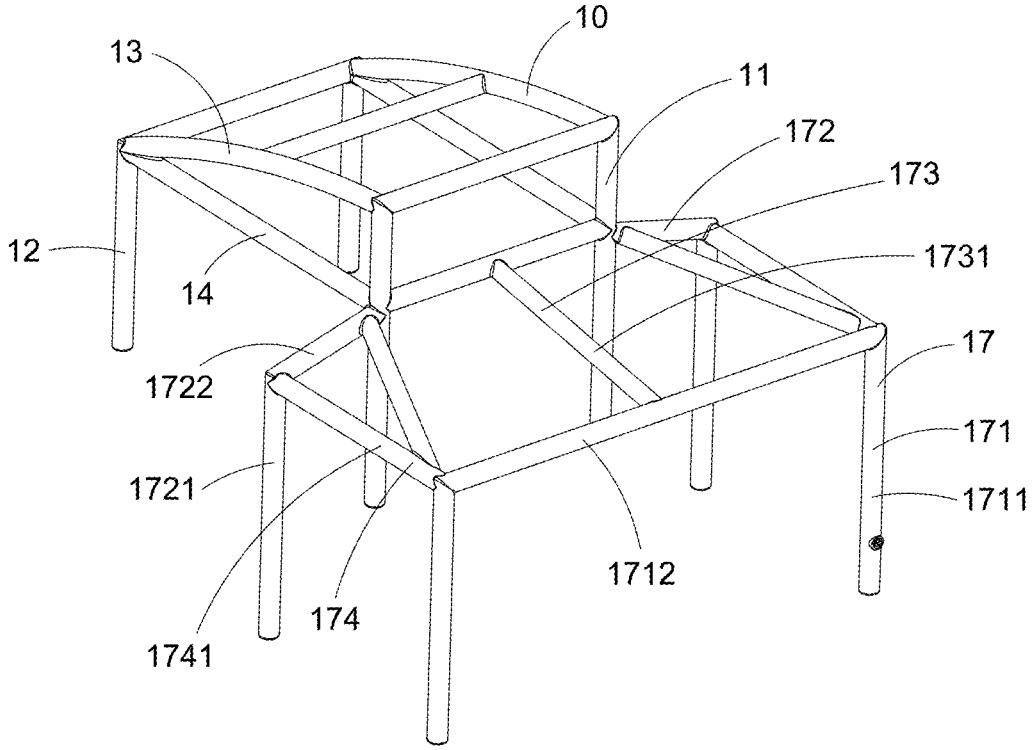
FIG. 32 is a perspective view illustrating an inflatable support assembly of an easy setup camping tent according to a fifth alternative mode of the above preferred embodiment of the present invention.
Figure 33:
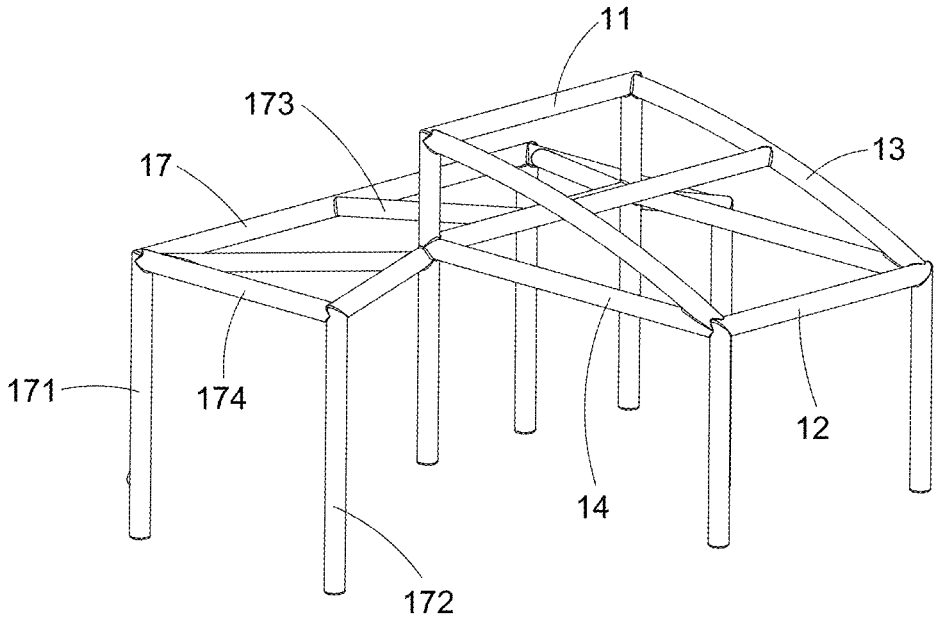
FIG. 33 is another perspective view illustrating the inflatable support assembly of the easy setup camping tent according to the fifth alternative mode of the above preferred embodiment of the present invention.
Figure 34:
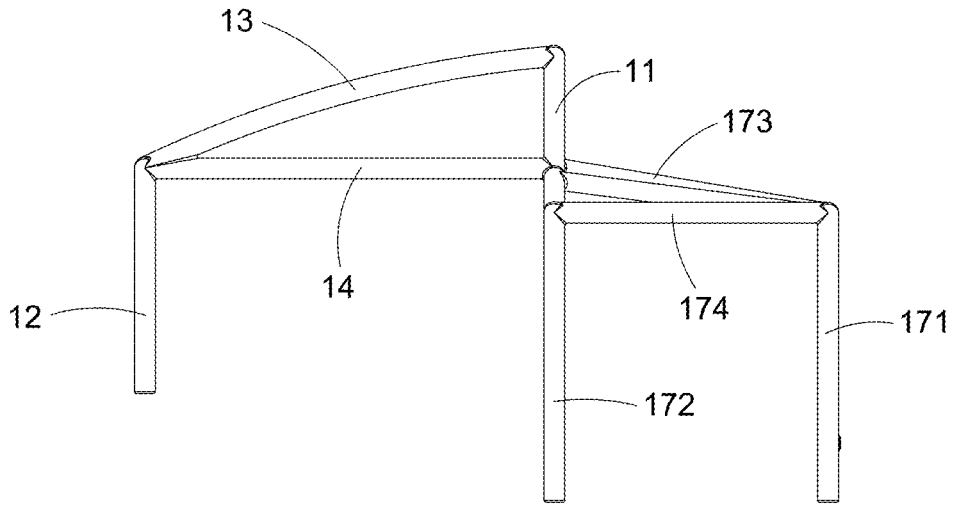
FIG. 34 is a side view illustrating the inflatable support assembly of the easy setup camping tent according to the fifth alternative mode of the above preferred embodiment of the present invention.
Figure 35:
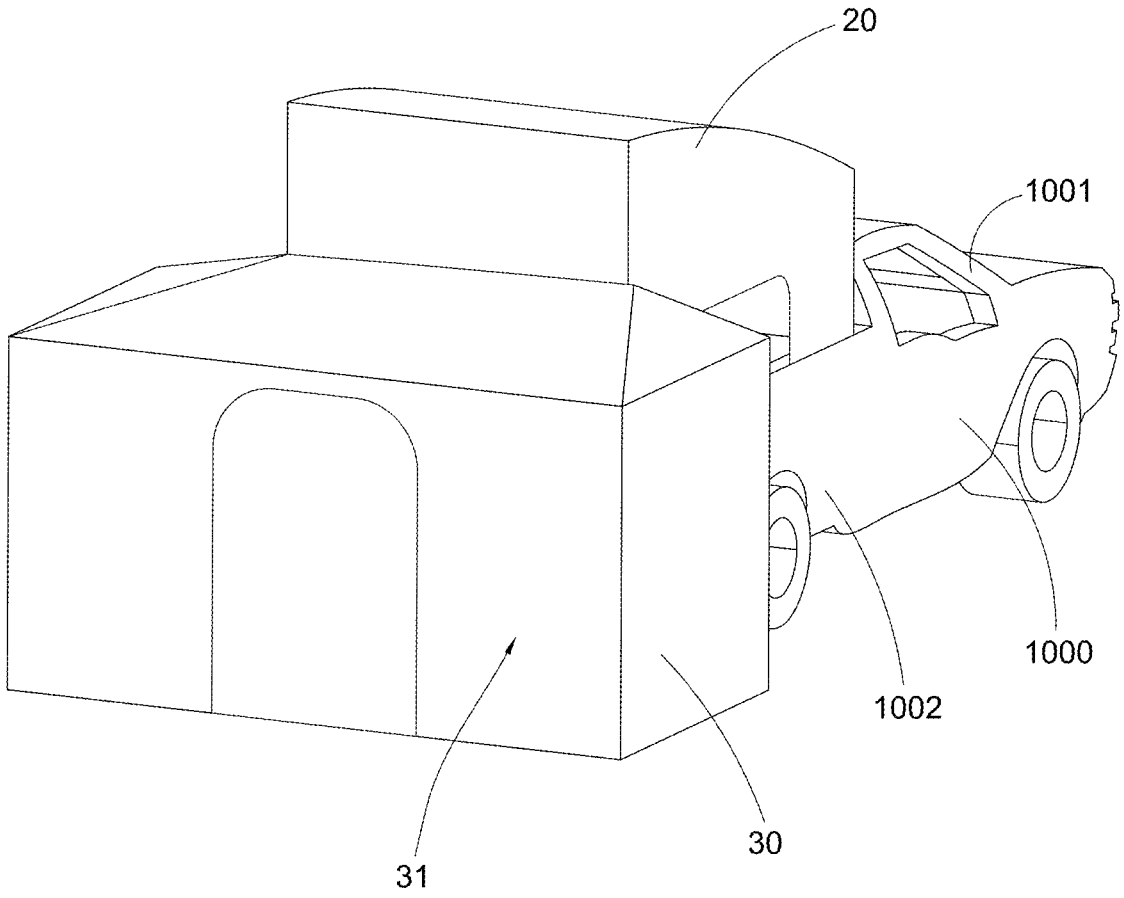
FIG. 35 is a side view illustrating the auxiliary tent and the inflatable support assembly of the easy setup camping tent according to the fifth alternative mode of the above preferred embodiment of the present invention.

Referring to FIGS. 29 to 31 of the drawings, an inflatable support assembly 10 according to a fourth alternative mode of the above embodiment of the present invention is illustrated, the inflatable support assembly 10 comprises a rear frame 11, a front frame 12, a top frame 13 connected between the rear frame 11 and the front frame 12, and a frame connecting structure 14 connecting the rear frame 11 to the front frame 12. More specifically, the rear frame 11 comprises two rear stand columns 111 and a rear upper column 112 which is embodied as a horizontal column extended between the two rear stand columns 111 when the inflatable support assembly 10 is inflated. In this embodiment, the rear frame 11 further comprises a rear middle column 113 which is located under the rear upper column 112.

The front frame 12 comprises two front stand columns 121 and a front upper column 122 which can be a horizontal column extended between the two front stand columns 121 when the inflatable support assembly 10 is inflated. The rear middle column 113 can be arranged parallel with the front upper column 122 and located at a same height. The frame connecting structure 14 comprises two connecting columns 141 connected between the rear frame 11 and the front frame 12, the two connecting columns 141, the rear middle column 113 and the front upper column 122 can be connected to form a horizontal rectangular frame when the inflatable support assembly 10 is inflated.

In this embodiment, the top frame 13 comprises a first top column 131 and a second top column 132 which are connected between the rear upper column 112 of the rear frame 11 and the front upper column 122 of the front frame 12. The top frame 13 further comprises a transverse column 135 which is extended between the first top column 131 and the second top column 132 to enhance a strength of the top frame 13.

In this embodiment, the first top column 131 and the second top column 132 are parallel with each other, a rear end 1311 of the first top column 131 and a rear end 1321 of the second top column 132 can be respectively connected to two joint positions between the rear upper column 112 of the rear frame 11 and the two rear stand columns 111. A front end 1312 of the first top column 131 and a front end 1322 of the second top column 132 can be respectively connected to joint positions between the front upper column 122 and the two front stand columns 121. In other words, rear ends of the two top columns are respectively connected to two ends of the rear upper column 112 while front ends of the two top columns are respectively connected to two ends of the front upper column 122.

When the easy setup camping tent is inflated for user, along the direction from the rear frame 11 to the front frame 12, both of the first top column 131 and the second top column 132 gradually slope downward, so that the top frame 13 forms a rear-high, front-low inclined roof structure. The forward slope of the top layer 22 of the tent body 20 also creates a streamlined surface facing the cab 1001 of the pickup truck 1000, thereby reducing air resistance and minimizing drag.

Referring to FIGS. 32 to 35 of the drawings, an inflatable support assembly 10 according to a fifth alternative mode of the above embodiment of the present invention is illustrated, the inflatable support assembly 10 of this embodiment is different from the above fourth alternative mode in that it further comprises the auxiliary frame unit 17 for supporting the auxiliary tent 30.

Similar to the above first alternative mode, the auxiliary frame unit 17, which is arranged to support the auxiliary tent 30, may comprise an auxiliary rear frame 171, an auxiliary front frame 172, an auxiliary top frame 173 and an auxiliary frame connecting structure 174. The auxiliary frame unit 17 can be inflated independently, or can be integrally connected to the rear frame 11, so that the auxiliary frame unit 17 can be inflated along with the rear frame 11, the front frame 12, the top frame 13, and the frame connecting structure 14.

The auxiliary rear frame 171 comprises two auxiliary rear stand columns 1711 and an auxiliary rear upper column 1712 connected between the two auxiliary rear stand columns 1711. Each auxiliary rear stand column 1711 which is arranged to be standing on the ground while each rear stand column 111 is arranged to be standing on the floor wall 10021 of the truck bed 1002. Accordingly, when the inflatable support assembly 10 is inflated for use, a bottom of the auxiliary rear frame 171 is arranged at a position lower than a bottom of the rear frame 11.

The auxiliary front frame 172 comprises two auxiliary front stand columns 1721 and two auxiliary front upper columns 1722 connected between the corresponding auxiliary front stand column 1711 and the rear frame 11. Each auxiliary front upper column 1722 is extended transversely from the corresponding rear stand column 111, and the auxiliary camping cavity 31 beside the pickup truck 1000 can have a larger volume and size than the camping cavity 24 in the tent body 20.

The auxiliary top frame 173 may comprise one or more auxiliary top columns 1731 connected between the auxiliary rear frame 171 and the auxiliary front frame 172. The auxiliary frame connecting structure 174 may comprise a plurality of auxiliary connecting columns 1741 connected between the auxiliary rear stand columns 1711 and the auxiliary front stand columns 1721.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A camping tent arranged for being used on a pickup truck comprising a cab and a truck bed, wherein the truck bed comprises a floor wall and two wheel wells protruded from the floor wall, wherein the camping tent comprises:

a tent body; and an inflatable support assembly connected to said tent body, wherein said tent body is unfolded when said inflatable support assembly is inflated, wherein said inflatable support assembly comprises a rear frame, a front frame and a top frame connected between said rear frame and said front frame;

wherein said camping tent is arranged for being detachably mounted on the truck bed with said front frame being located adjacent to the cab while said rear frame being located away from the cab, said tent body comprises a bottom layer, a top layer, an enclosing layer between said bottom layer and said top layer and two wheel well covers protruded from said bottom layer to cover the two wheel wells respectively in a manner that each said wheel well cover defines a wheel well cavity for accommodating the corresponding wheel well under the corresponding wheel well cover when said inflatable support assembly is inflated;

wherein said inflatable support assembly is mounted at an inner side of said tent body, wherein said tent body has a camping cavity and comprises a rear enclosing wall, a front enclosing wall, and a door layer coupled to said rear enclosing wall to define an access opening communicated to said camping cavity, wherein said rear frame is arranged to support said rear enclosing wall with said door layer, said front frame is arranged to support said front enclosing wall, wherein when said inflatable support assembly is inflated, along a direction from said rear frame to said front frame, said top frame gradually slopes downward toward the cab;

wherein said rear frame comprises two rear stand columns and a rear upper column extended between the two rear stand columns to support said rear enclosing wall with said door layer, said front frame comprises two front stand columns and a front upper column extended between the two front stand columns, wherein said top frame comprises two top columns, wherein rear ends of said two top columns are connected to a same position of said rear upper column of said rear frame, front ends of said two top columns are respectively connected to two different positions of said front frame, wherein when said inflatable support assembly is inflated, along the direction from said rear frame to said front frame, said two top columns gradually slope downward toward the cab.

2. The camping tent, as recited in claim 1, wherein said tent body comprises a bottom layer, a top layer and an enclosing layer between said bottom layer and said top layer, wherein said enclosing layer comprises said rear enclosing wall and said front enclosing wall, wherein said two top columns are arranged under said top layer of said tent body and are extended between said rear upper column and said front upper column, wherein when said inflatable support assembly is inflated, along the direction from said rear frame to said front frame, said top layer gradually slope downward toward the cab.

3. A camping tent arranged for being used on a pickup truck comprising a cab and a truck bed, wherein the truck bed comprises a floor wall and two wheel wells protruded from the floor wall, wherein the camping tent comprises:

a tent body; and an inflatable support assembly connected to said tent body, wherein said tent body is unfolded when said inflatable support assembly is inflated, wherein said inflatable support assembly comprises a rear frame, a front frame and a top frame connected between said rear frame and said front frame;

wherein said camping tent is arranged for being detachably mounted on the truck bed with said front frame being located adjacent to the cab while said rear frame being located away from the cab, said tent body comprises a bottom layer, a top layer, an enclosing layer between said bottom layer and said top layer and two wheel well covers protruded from said bottom layer to cover the two wheel wells respectively in a manner that each said wheel well cover defines a wheel well cavity for accommodating the corresponding wheel well under the corresponding wheel well cover when said inflatable support assembly is inflated;

wherein said enclosing layer comprises a rear enclosing wall, a front enclosing wall, two side enclosing walls extended between said rear enclosing wall and said front enclosing wall, and a door layer coupled to said rear enclosing wall to define an access opening communicated to said camping cavity, wherein said enclosing layer further comprises an upper enclosing layer which is covered on an upper end portion of said rear enclosing wall, and one or more support struts provided between said upper enclosing layer and said upper end portion of said rear enclosing wall, wherein said upper end portion of said rear enclosing wall has one or more vent holes, said one or more support struts are capable of being in a support state to allow said upper enclosing wall and said upper end portion of said rear enclosing wall to be spaced apart from each other to expose said one or more vent holes, wherein when said one or more support struts are detached from said upper enclosing wall, said upper enclosing wall is covered on said upper end portion of said rear enclosing wall to hide said one or more vent holes.

* * * * *